US007385573B2

(12) United States Patent
Osame et al.

(10) Patent No.: US 7,385,573 B2
(45) Date of Patent: Jun. 10, 2008

(54) DISPLAY DEVICE AND DRIVING METHOD THEREOF

(75) Inventors: Mitsuaki Osame, Kanagawa (JP); Aya Anzai, Kabagawa (JP); Tomoyuki Iwabuchi, Kanagawa (JP); Hideyuki Ebine, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 815 days.

(21) Appl. No.: 10/808,584

(22) Filed: Mar. 25, 2004

(65) Prior Publication Data

US 2005/0017928 A1 Jan. 27, 2005

(30) Foreign Application Priority Data

Mar. 26, 2003 (JP) ..... 2003-086570
Jul. 17, 2003 (JP) ..... 2003-275723
Dec. 19, 2003 (JP) ..... 2003-423580

(51) Int. Cl.
*G09G 3/30* (2006.01)

(52) U.S. Cl. ..... 345/76; 345/79; 345/80; 345/82

(58) Field of Classification Search ..... 345/76, 345/79–80, 82
See application file for complete search history.

(56) References Cited

U.S. PATENT DOCUMENTS 5,606,348 A 2/1997 Chiu
5,876,865 A 3/1999 Hsieh
5,899,575 A 5/1999 Okayama et al.

(Continued)

FOREIGN PATENT DOCUMENTS

EP 1 094 438 4/2001

(Continued)

OTHER PUBLICATIONS

International Search Report dated Jun. 1, 2004 for PCT/JP2004/003547, 6 pages.

(Continued)

*Primary Examiner*—Richard Hjerpe
*Assistant Examiner*—Leonid Shapiro
(74) *Attorney, Agent, or Firm*—Eric J. Robinson; Robinson Intellectual Property Law Office, P.C.

(57) ABSTRACT

It is provided a display device that prevents, when applying a reverse bias, an anode line and a power supply line included in a signal line driver circuit from being short-circuited, and a driving method thereof. According to the invention, a reverse bias applying circuit is provided in a scan line driver circuit or a signal line driver circuit, a signal from the reverse bias applying circuit is supplied to a transistor disposed between a signal line and an anode line, and thereby the transistor is turned off. The reverse bias applying circuit comprises an analog switch or a clocked inverter and a biasing transistor, and drives so as to invert potentials of the anode line and a cathode line and apply a reverse bias to a light emitting element, while turn off the analog switch and turn on the biasing transistor. Then, a potential of the anode line becomes equal to that of a scan line, and thereby turning off the transistor between the anode line and the signal line assuredly.

11 Claims, 15 Drawing Sheets

U.S. PATENT DOCUMENTS

| | | | | |
|---|---|---|---|---|
| 5,990,629 | A | 11/1999 | Yamada et al. | |
| 6,166,490 | A | 12/2000 | Hansen | |
| 6,225,750 | B1 | 5/2001 | Kimura | |
| 6,246,384 | B1 | 6/2001 | Sano | |
| 6,351,077 | B1 | 2/2002 | Koyama | |
| 6,366,026 | B1 | 4/2002 | Saito et al. | |
| 6,373,454 | B1 | 4/2002 | Knapp et al. | |
| 6,373,455 | B1 | 4/2002 | Kuribayashi et al. | |
| 6,380,689 | B1 * | 4/2002 | Okuda | 315/169.3 |
| 6,417,825 | B1 | 7/2002 | Stewart et al. | |
| 6,504,520 | B1 | 1/2003 | Osada et al. | |
| 6,528,950 | B2 | 3/2003 | Kimura | |
| 6,542,138 | B1 | 4/2003 | Shannon et al. | |
| 6,548,960 | B2 | 4/2003 | Inukai | |
| 6,750,833 | B2 | 6/2004 | Kasai | |
| 6,809,482 | B2 | 10/2004 | Koyama | |
| 6,903,731 | B2 | 6/2005 | Inukai | |
| 7,012,587 | B2 * | 3/2006 | Satoh et al. | 345/82 |
| 7,113,154 | B1 | 9/2006 | Inukai | |
| 2002/0047839 | A1 | 4/2002 | Kasai | |
| 2007/0052635 | A1 * | 3/2007 | Kimura | 345/76 |

FOREIGN PATENT DOCUMENTS

| | | |
|---|---|---|
| EP | 1 103 946 | 5/2001 |
| EP | 1 191 512 | 3/2002 |
| JP | 2000-268957 | 9/2000 |
| JP | 2001-117534 | 4/2001 |
| JP | 2001-343933 | 12/2001 |
| JP | 2002-169510 | 6/2002 |

OTHER PUBLICATIONS

Written Opinion dated Jun. 1, 2004 for PCT/JP2004/003547, 4 pages.

* cited by examiner

DISPLAY DEVICE AND DRIVING METHOD THEREOF

TECHNICAL FIELD

The present invention relates to a display device using a self-luminous type light emitting element, and to a driving method thereof.

BACKGROUND ART

In recent years, a display device including a light emitting element has been developed. The display device including a light emitting element has the features such as fast response and wide viewing angle, in addition to the advantages of an existing liquid crystal display device, such as high image quality, thinness and lightweight. Therefore, it has been developed mainly for use as portable terminal. A light emitting element comprises between two electrodes a layer formed of various materials such as an organic material and an inorganic material.

A light emitting material has the feature that the luminance thereof degrades with time. Thus, in order to suppress the degradation of a light emitting element and improve the reliability, there is a method that applies a reverse bias voltage to the light emitting element (see Patent Document 1). Furthermore, there is a display device comprising in one pixel an EL driving TFT that is connected in series with a light emitting element and controls light emission of the light emitting element, a switching transistor (also called a writing transistor) for controlling a video signal input to the pixel, and an erasing TFT (also called a reset transistor) for controlling on/off of the EL driving TFT (see Patent Document 2).

[Patent Document 1] Japanese Patent Application No. 2001-117534

[Patent Document 2] Japanese Patent Application No. 2001-343933

DISCLOSURE OF THE INVENTION

[Problems to be Solved by the Invention]

FIG. 9 shows a circuit diagram of one pixel disclosed in Patent Document 2. In FIG. 9, when a reverse bias being applied to a light emitting element 54, potentials of an anode line 18 and a cathode line 19 are inverted. To give an example of specific condition, potentials are inverted such that a potential of the anode line 18 changes from 7 V to −8 V while a potential of the cathode line 19 changes from −8 V to 7 V. At this time, in the case of gate electrodes of transistors 51 and 52 being inputted with an off signal voltage (0 V), a gate-source voltage of both the TFTs becomes equal to |8 V|, and thereby the transistors 51 and 52 are turned on at the instant of inverting the potentials of the anode line 18 and the cathode line 19. Then, a current flows as shown in the drawing, and a signal line driver circuit 103 and the anode line 18 are short-circuited.

A transistor 53 controls the amount of current flowing to the light emitting element 54.

In view of the foregoing, the invention provides a display device comprising an anode line connected through a transistor to a signal line, in which when a reverse bias is applied, the anode line and a power supply line included in a signal line driver circuit are prevented from being short-circuited, and provides a driving method thereof.

[Means for Solving the Problems]

In order to solve the aforementioned problems of prior art, the invention takes the following measures. As a first mean, a display device comprising a scan line driver circuit provided with a reverse bias applying circuit is provided. Further, it provides a driving method of a display device that supplies a signal from the reverse bias applying circuit to a transistor disposed between a signal line and an anode line, and turns off the transistor when applying a reverse bias to a light emitting element, and thereby prevents the signal line and the anode line from being short-circuited.

The reverse bias applying circuit comprises an analog switch or a clocked inverter, and a biasing transistor. The analog switch comprises a first transistor whose gate electrode is connected to the anode line and a second transistor whose gate electrode is connected to a cathode line.

The clocked inverter has a configuration in which a transistor whose source potential has the same potential as a low potential voltage VSS and whose gate electrode is connected to the anode line is disposed at one end, whereas a transistor whose source potential has the same potential as a high potential voltage VDD and whose gate electrode is connected to the cathode line is disposed at the other end.

The clocked inverter has another configuration different from the above, in which a transistor whose source potential has the same potential as a low potential voltage VSS and whose gate electrode is connected through a first level shifter to the anode line is disposed at one end, whereas a transistor whose source potential has the same potential as a high potential voltage VDD and whose gate electrode is connected through a second level shifter to the cathode line is disposed at the other end. The first or the second level shifter may be removed if not required for operation depending on voltage conditions. For instance, the first level shifter may be removed.

A gate electrode of the biasing transistor is connected to a power supply line with a constant potential, a first electrode thereof is connected to the anode line, and a second electrode thereof is connected to an output terminal of the analog switch and a scan line.

A display device having the aforementioned configuration is driven so that potentials of the anode line and the cathode line are inverted and a reverse bias is applied to the light emitting element while turning off the analog switch and turning on the biasing transistor. Thus, since a potential of the anode line can be equal to a potential of the scan line, a driving method of a display device, that assuredly turns off the transistor disposed between the anode line and the signal line can be provided.

Secondly, a display device comprising a signal line driver circuit that is provided with a reverse bias applying circuit is provided. The reverse bias applying circuit comprises a switch that prevents a power supply line included in the signal line driver circuit and an anode line from being short-circuited. This switch is determined to be on/off by utilizing potentials of the anode line and a cathode line.

The reverse bias applying circuit comprises an analog switch. The analog switch comprises an analog switch that includes a first transistor whose gate electrode is connected to the anode line and a second transistor whose gate electrode is connected to the cathode line. An output terminal of the analog switch is electrically connected to a signal line.

A display device having the aforementioned configuration is driven so that the potentials of the anode line and the cathode line are inverted and a reverse bias is applied to a light emitting element while turning off the analog switch. Thus, since the switch disposed between the anode line and the power supply line included in the signal line driver circuit can be turned off assuredly, a driving method of a display device, that prevents the anode line and the power supply line included in the signal line driver circuit from being short-circuited can be provided.

The display device of the invention is characterized by having a light emitting element, one of two electrodes of which is connected to an anode line and the other of which is connected to a cathode line. It is to be noted that in the invention, an anode line is a wiring connected to a pixel electrode (anode) of a light emitting element whereas a cathode line is a wiring connected to a opposite electrode (cathode) of the light emitting element.

A scan line corresponds to all the wirings connected to gate electrodes of transistors between a signal line and an anode line. When taking as an example the pixel shown in FIG. 9, the transistors 51 and 52 are disposed between a signal line 57 and the anode line 18, therefore, a scan line 58 and a reset line 59 connected to the gate electrodes of the transistors 51 and 52 correspond to scan lines here.

[Effect of the Invention]

According to the invention, a reverse bias applying circuit is provided in a scan line driver circuit or a signal line driver circuit, and the reverse bias applying circuit takes advantage of the fact that potentials of an anode line and a cathode line are inverted when a reverse bias being applied to a light emitting element. A transistor disposed between the anode line and a signal line is turned off assuredly by use of a signal supplied from the reverse bias applying circuit, and thereby the signal line and the anode line can be prevented from being short-circuited. Further, a switch between the anode line and a power supply line included in the signal line driver circuit is turned off assuredly, and thereby the anode line and the power supply line included in the signal line driver circuit can be prevented from being short-circuited. In addition, a reverse bias is applied to a light emitting element, and thereby it can be suppressed that the light emitting element degrades with time.

BEST MODE FOR CARRYING OUT THE INVENTION

Figure 1:
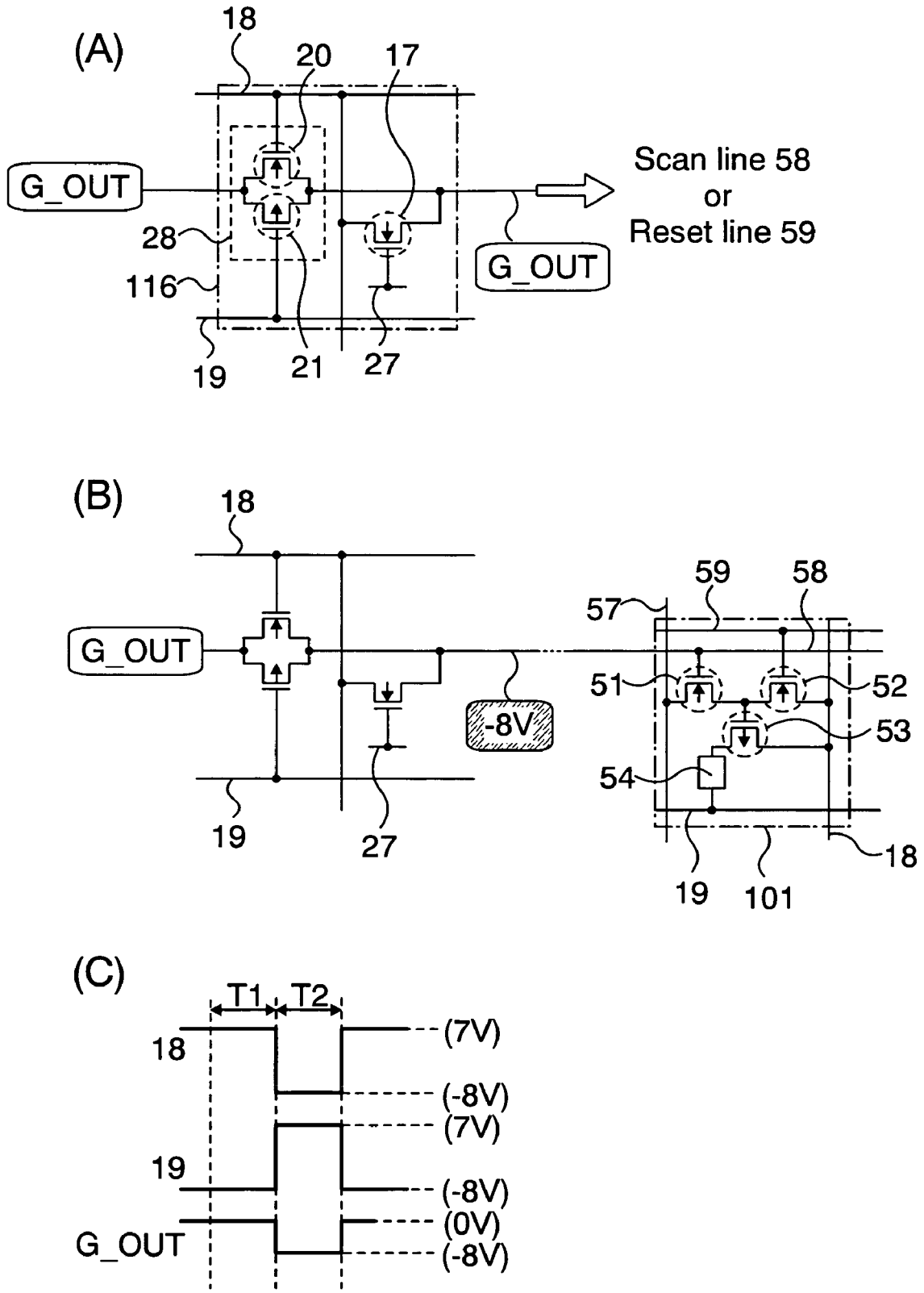
FIG. 1 shows diagrams for describing the display device and the driving method thereof according to the invention (Embodiment Mode 1).

Embodiment modes of the invention will be described with reference to the drawings in detail. However, it is to be understood that the invention is not limited to the following description and various changes and modifications will be apparent to those skilled in the art. Therefore, unless such changes and modifications depart from the scope of the invention, they should be constructed as being included therein. Note that in the configurations of the invention described hereinafter, the same parts are denoted by the same reference numerals in different drawings.

Embodiment Mode 1

In this embodiment mode, a reverse bias applying circuit included in a scan line driver circuit is described. A signal outputted from the reverse bias applying circuit is supplied to a transistor disposed between a signal line and an anode line in a pixel. When a reverse bias being applied to a light emitting element, the transistor is turned off to prevent the signal line and the anode line from being short-circuited. Although a plurality of transistors are disposed between the signal line and the anode line, at least one of the transistors has only to be turned off assuredly.

Figure 9:
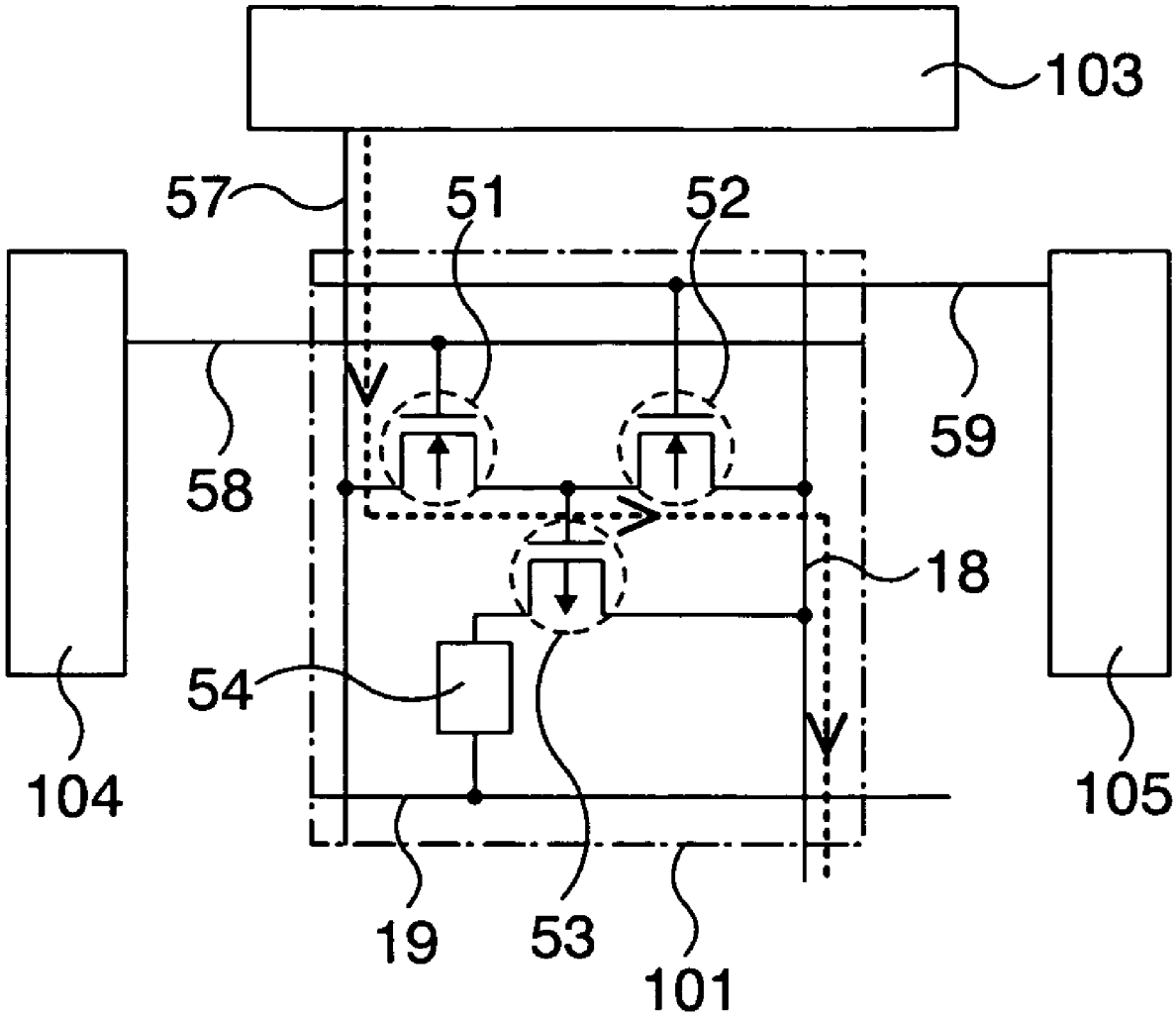
FIG. 9 shows a diagram for describing a display device and a driving method thereof.

The pixel configuration shown in FIG. 9 taken as an example in this embodiment mode, the case in which a reverse bias applying circuit 116 is connected to the scan line 58 or the reset line 59 is described. A signal from the reverse bias applying circuit 116 is supplied to the transistor 51 connected to the scan line 58 or the transistor 52 connected to the reset line 59. When turning off either the transistor 51 or 52, the signal line 57 and the anode line 18 are prevented from being short-circuited.

In FIGS. 1(A) and 1(B), the reverse bias applying circuit 116 comprises an analog switch 28 including an N-channel transistor 20 and a P-channel transistor 21. An output terminal of the analog switch 28 is connected to the scan line 58 or the reset line 59. The reverse bias applying circuit 116 further comprises an N-channel biasing transistor 17. A gate electrode of the biasing transistor 17 is connected to a power supply line 27, a source electrode thereof being connected to one of the anode line 18 and the output terminal of the analog switch 28, and a drain electrode thereof being connected to the other of the anode line 18 and the output terminal of the analog switch 28. A potential of the power supply line 27 is kept constant, which is set at 0 V here. The gate electrode of the transistor 17 has only to be connected to a wiring with a constant potential, and in this embodiment mode, it is connected to the power supply line 27 as an example.

Operations are described with reference to a timing chart of FIG. 1(C). In FIG. 1(C), a period of applying a reverse bias to a light emitting element is denoted by T2 while the other period is denoted by T1, and operations in the periods T1 and T2 are explained. Operations described herein are carried out under the conditions, for instance, such that an anode is 7 V, a cathode is −8 V, VDD is 10 V, and VSS is 0 V.

In the period T1 (see FIG. 1(A)), since a potential of the anode line 18 is 7 V, a potential of the cathode line 19 is −8 V, and a potential of the power supply line 27 is 7 V, the transistor 17 is turned off while the transistors 20 and 21 are turned on. Then, a G-OUT is outputted from the analog switch 28. It is to be noted that the G-OUT is a signal outputted from a circuit adjacent to the reverse bias applying circuit, and it is a signal, for instance, outputted from a buffer.

In the period T2 (see FIG. 1(B)), the potentials of the anode line 18 and the cathode line 19 are inverted. Specifically, the potential of the anode line 18 changes from 7 V to −8 V, and the potential of the cathode line 19 changes from −8 V to 7 V. Thus, the transistor 17 is turned on and the transistors 20 and 21 are turned off, and thereby the analog switch 28 is turned off (non-conducting state). At the same time, the potential of the anode line 18 is transferred through the transistor 17 to the scan line 58 or the reset line 59, thus the potential of the anode line 18 (−8 V herein) becomes equal to the potential of the scan line 58 or the reset line 59.

In the case of FIG. 1(B), since the output terminal of the analog switch 28 is connected to the scan line 58, the potentials of the anode line 18 and the scan line 58 becomes equal to each other. Accordingly, a gate-source voltage of the transistor 51 connected to the scan line 58 becomes 0 V and the transistor 51 is turned off, and thereby the signal line 57 and the anode line 18 can be prevented from being short-circuited. As set forth above, according to the invention, when the potential of the scan line 58 or the reset line 59 is made equal to the potential of the anode line 18, the transistor 51 or the transistor 52 is turned off assuredly, and thereby the signal line and the anode line 18 are prevented from being short-circuited.

Another embodiment mode different from the above is described next with reference to FIG. 2. More specifically, explanation is made on the reverse bias applying circuit 116 that includes a clocked inverter instead of the analog switch 28.

In FIGS. 2(A) and 2(B), the reverse bias applying circuit 116 comprises a clocked inverter 29 in which an N-channel transistor 11, an N-channel transistor 12, a P-channel transistor 13, and a P-channel transistor 14 (hereinafter referred to as transistors 11, 12, 13, and 14) are connected in series. An output terminal of the clocked inverter 29 is connected to the scan line 58 or the reset line 59. A source of the transistor 11 is at the same potential as VSS, a gate electrode thereof being connected to the anode line 18. A source of the transistor 14 is at the same potential as VDD, a gate electrode thereof being connected to the cathode line 19. The reverse bias applying circuit 116 further comprises the N-channel biasing transistor 17. A potential of the power supply line 27 is kept constant and set also at 0 V herein.

Operations are described, similarly to the above embodiment mode, with reference to the timing chart of FIG. 1(C). The operations explained here are carried out under the conditions, for instance, such that an anode is 7 V, a cathode is −8 V, VDD is 7 V, and VSS is 0 V.

In the period T1 (see FIG. 2(A)), since a potential of the anode line 18 is 7 V and a potential of the cathode line 19 is −8 V, the transistors 11 and 14 are turned on while the transistor 17 is turned off. At this time, a G-OUTB (inverted signal of the G-OUT) is outputted from the clocked inverter 29.

In the period T2 (see FIG. 2(B)), the potential of the anode line 18 changes from 7 V to −8 V, and the potential of the cathode line 19 changes from −8 V to 7 V. Thus, the transistors 11 and 14 are turned off and the clocked inverter 29 enters a high impedance state. At the same time, the potential of the anode line 18 is transferred through the transistor 17 to the scan line 58 or the reset line 59, thus the potential of the anode line 18 (−8 V herein) becomes equal to the potential of the scan line 58 or the reset line 59. Then, either of the transistor 51 connected to the scan line 58 or the transistor 52 connected to the reset line 59 is turned off, and thereby the signal line 57 and the anode line 18 can be prevented from being short-circuited.

Figure 2:
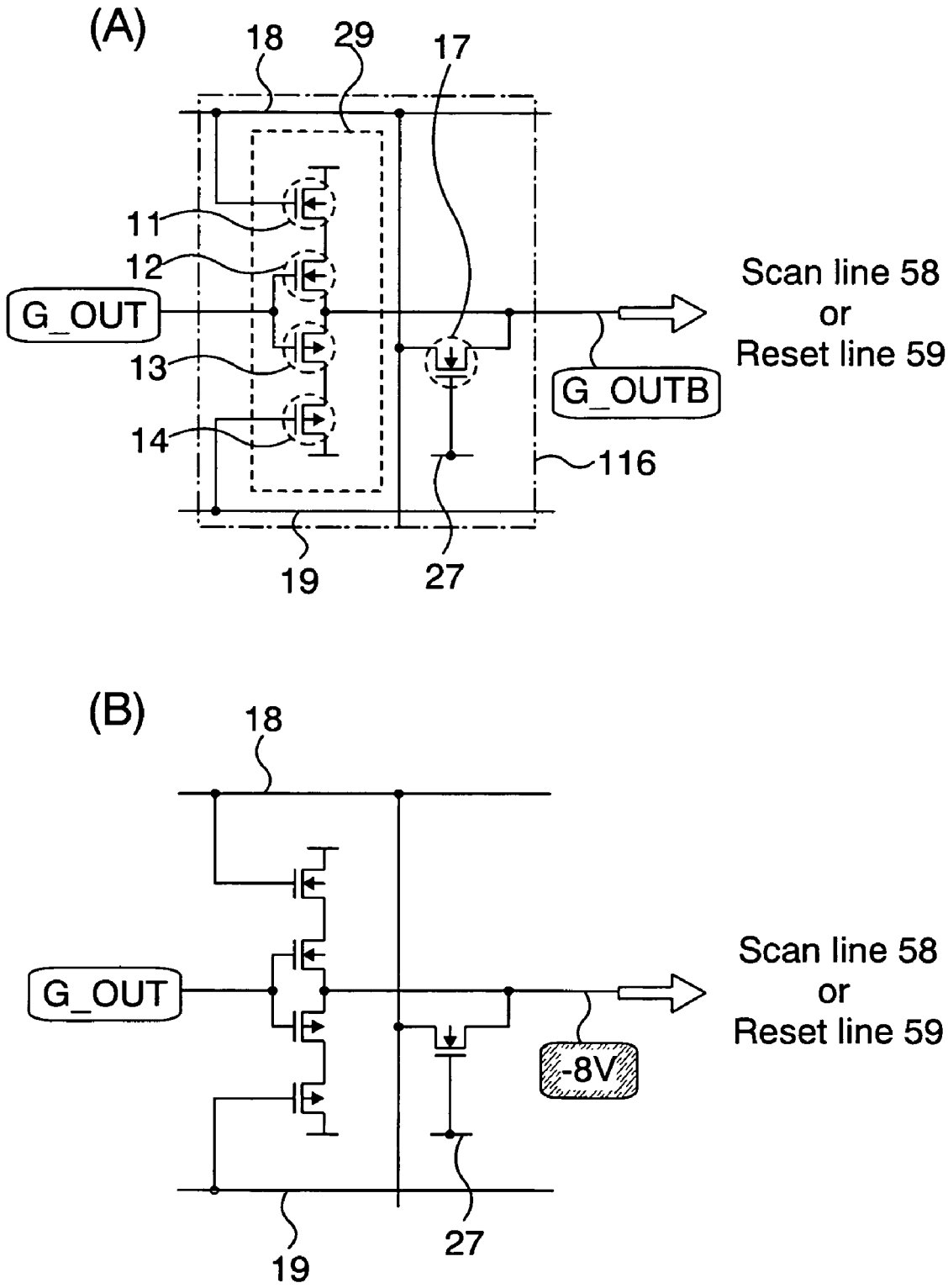
FIG. 2 shows diagrams for describing the display device and the driving method thereof according to the invention (Embodiment Mode 1).

In the configuration shown in FIG. 2, when the relation between the potential $V_a$ of the anode line 18 and the VDD is such that $V_a$<VDD, the transistor 14 is turned on when a reverse bias being applied, and thus the clocked inverter 29 cannot enter a high impedance state. Therefore, it is indispensable for the potential $V_a$ of the anode line 18 and VDD that $V_a \leqq$VDD be satisfied.

Figure 3:
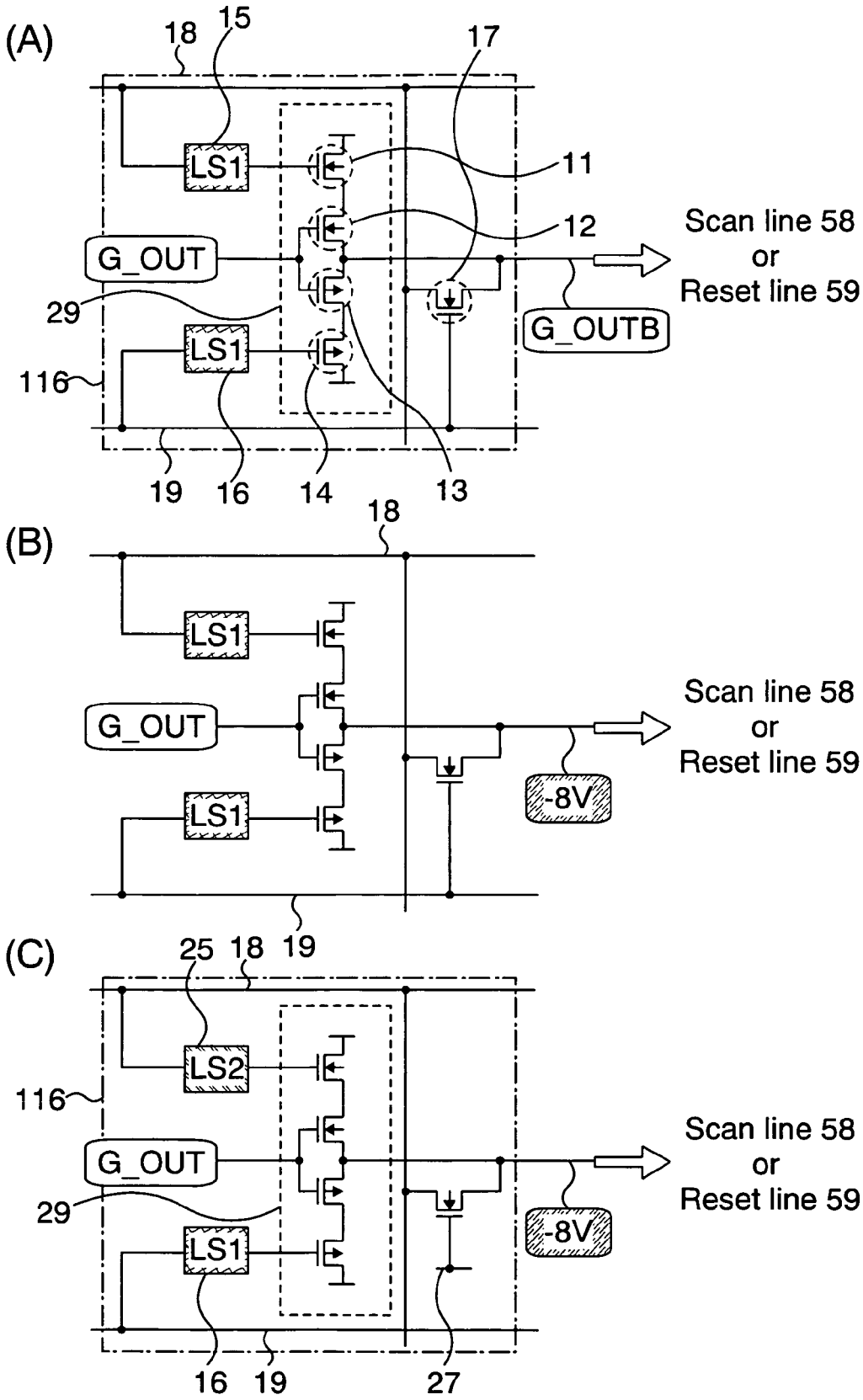
FIG. 3 shows diagrams for describing the display device and the driving method thereof according to the invention (Embodiment Mode 1).

Still another embodiment mode different from the above is described next with reference to FIGS. 3(A) and 3(B). More specifically, explanation is made on the reverse bias applying circuit 116 that includes a level shifter.

In FIGS. 3(A) and 3(B), the reverse bias applying circuit 116 comprises a level shifter (LS1) 15 between the gate electrode of the transistor 11 and the anode line 18, and a level shifter (LS1) 16 between the transistor 14 and the cathode line 19. The other configuration is the same as that shown in FIG. 2 except in that the gate electrode of the transistor 17 is connected to the cathode line 19. It is to be noted that the gate electrode of the transistor 17 has only to be connected to a wiring with a constant potential, and may be connected to another power supply line instead of the cathode line 19. The level shifters (LS1) 15 and 16 have a function to change 7 V to 10 V, and −8 V to −8 V, the configuration of which will be described in more detail hereinafter.

Operations are described, similarly to the above embodiment mode, with reference to the timing chart of FIG. 1(C). The operations explained here are carried out under the conditions, for instance, such that an anode is 7 V, a cathode is, −8 V, VDD is 10 V, and VSS is 0 V.

In the period T1 (see FIG. 3(A)), since a potential of the anode line 18 is 7 V and a potential of the cathode line 19 is −8 V, a signal of 10 V is supplied through the level shifter 15 to the transistor 11 whereas a signal of −8 V is supplied through the level shifter 16 to the transistor 14. Then, the transistors 11 and 14 are turned on while the transistor 17 is turned off. At this time, a G-OUTB is outputted from the clocked inverter 29.

In the period T2 (see FIG. 3(B)), since the potential of the anode line 18 changes from 7 V to −8 V and the potential of the cathode line 19 changes from −8 V to 7 V, a signal of −8 V is supplied through the level shifter 15 to the transistor 11 whereas a signal of 10 V is supplied through the level shifter 16 to the transistor 14. Thus, the transistors 11 and 14 are turned off and the clocked inverter 29 enters a high impedance state. At the same time, the potential of the anode line 18 is transferred through the transistor 17 to the scan line 58 or the reset line 59, thus the potential of the anode line 18 (−8 V herein) becomes equal to the potential of the scan line 58 or the reset line 59. Then, either of the transistor 51 connected to the scan line 58 or the transistor 52 connected to the reset line 59 is turned off, and thereby the signal line 57 and the anode line 18 can be prevented from being short-circuited.

The level shifters 15 and 16 are provided in order to turn off assuredly the transistors 11 and 14 that constitute the clocked inverter 29. More specifically, in the case of a reverse bias being applied, that is, the potentials of the anode line 18 and the cathode line 19 being inverted, when the potential of the cathode line 19 (7 V in this period) is supplied to the transistor 14, a current may flow between the source and the drain due to the gate potential (7 V) and the drain potential (VDD, 10 V) depending on characteristics of the respective transistor. Thus, the level shifter 16 is disposed therebetween in order to make the gate potential of the transistor 14 equal to the drain potential (VDD, 10 V) thereof, and thereby no current flows between the source and the drain. In the configuration shown in FIG. 3, the potential of the anode line 18 is transferred through the level shifter 15 to the transistor 11 without change, therefore, the level shifter 15 is not necessarily provided.

Subsequently, still another embodiment mode different from the above is described with reference to FIG. 3(C).

In FIG. 3(C), the reverse bias applying circuit 116 comprises a level shifter (LS2) 25 between the gate electrode of the transistor 11 and the anode line 18. The other configuration is the same as those shown in FIGS. 3(A) and 3(B), except in that the gate electrode of the transistor 17 is connected to the power supply line 27. The level shifter 25 has a function to change 7 V to 7 V, and −8 V to 0 V, the configuration of which will be described in more detail hereinafter.

Operations are described, similarly to the above embodiment mode, with reference to the timing chart of FIG. 1(C). The operations explained here are carried out under the conditions, for instance, such that an anode is 7 V, a cathode is −8 V, VDD is 10 V, and VSS is 0 V.

In the period T1, since a potential of the anode line 18 is 7 V and a potential of the cathode line 19 is −8 V, a signal of 7 V is supplied through the level shifter 25 to the transistor 11 whereas a signal of −8 V is supplied through the level shifter 16 to the transistor 14. Then, the transistors 11 and 14 are turned on while the transistor 17 is turned off. At this time, a G-OUTB is outputted from the clocked inverter 29.

In the period T2 (see FIG. 3(C)), since the potential of the anode line 18 changes from 7 V to −8 V and the potential of the cathode line 19 changes from −8 V to 7 V, a signal of 0 V is supplied through the level shifter 25 to the transistor 11 whereas a signal of 10 V is supplied through the level shifter 16 to the transistor 14. Thus, the transistors 11 and 14 are turned off and the clocked inverter 29 enters a high impedance state. At the same time, the potential of the anode line 18 is transferred through the transistor 17 to the scan line 58 or the reset line 59, thus the potential of the anode line 18 (−8 V herein) becomes equal to the potential of the scan line 58 or the reset line 59. Then, either of the transistor 51 connected to the scan line 58 or the transistor 52 connected to the reset line 59 is turned off, and thereby the signal line 57 and the anode line 18 can be prevented from being short-circuited.

Embodiment Mode 2

In this embodiment mode, a reverse bias applying circuit included in a signal line driver circuit is described. The reverse bias applying circuit includes a switch for preventing a power supply line included in the signal line driver circuit and the anode line 18 from being short-circuited. This switch is determined to be on/off by utilizing potentials of the anode line 18 and the cathode line 19.

Figure 4:
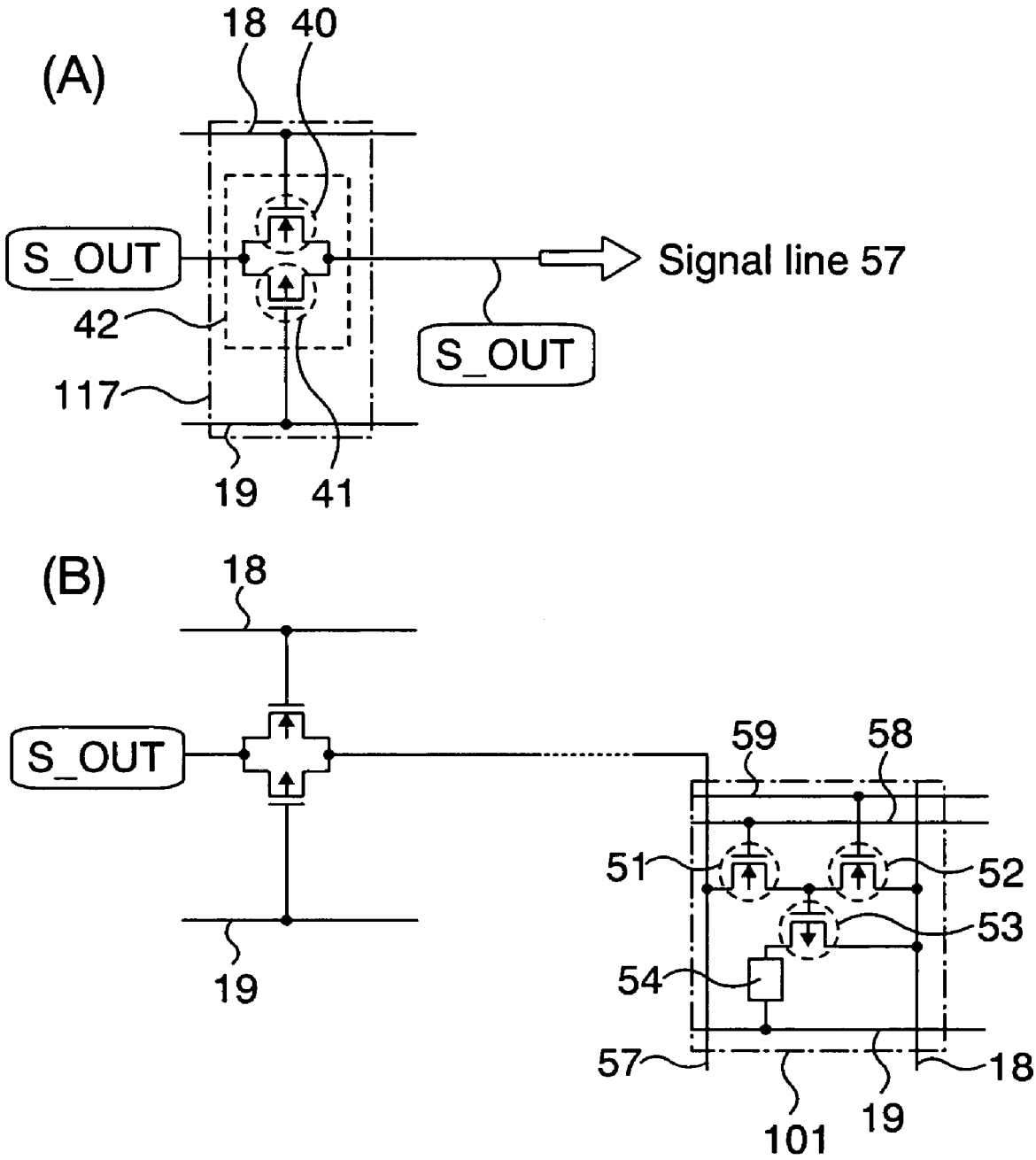
FIG. 4 shows diagrams for describing the display device and the driving method thereof according to the invention (Embodiment Mode 2).

In FIG. 4, a reverse bias applying circuit 117 comprises an analog switch 42 that includes an N-channel transistor 40 and a P-channel transistor 41, and the analog switch 42 is connected to a signal line 57.

Operations are described hereinafter. The operations explained here are carried out under the conditions, for instance, such that an anode is 7 V and a cathode is −8 V.

During a period in which a reverse bias is not applied to a light emitting element, since a potential of the anode line 18 is 7 V and a potential of the cathode line 19 is −8 V, the transistors 40 and 41 are turned on. At this time, an S-OUT is outputted from the analog switch 42.

During a period in which a reverse bias is applied to a light emitting element, the potential of the anode line 18 changes from 7 V to −8 V and the potential of the cathode line 19 changes from −8 V to 7 V. Thus, the transistors 40 and 41 are turned off, the analog switch 42 being turned off (non-conducting state). Accordingly, a power supply line included in the signal line driver circuit and the anode line 18 can be prevented from being short-circuited.

Embodiment Mode 3

Described above is the case of providing an analog switch as an element that constitutes a reverse bias applying circuit and the operation thereof (FIGS. 1 and 4). Described in this embodiment mode is the case of using a depletion mode transistor which is normally on as a transistor that constitutes an analog switch.

A threshold voltage of a transistor can be controlled by adjusting the dosage of an impurity that imparts a conductivity relative to a channel forming region or the like. In other words, a depletion mode transistor can be formed by adjusting the dosage relative to a channel forming region or the like.

In the case of the same gate voltage being applied to a depletion mode transistor and an enhancement mode transistor which is normally off, the absolute value of a gate overdrive voltage (gate voltage Vgs−threshold voltage Vth) is higher in the depletion mode transistor. That is, in the depletion mode transistor, a higher on-current can be obtained even with the same gate voltage. Further, in the case where the on-current may be same as that of the enhancement mode transistor, the channel length (L) and the channel width (W) thereof can be shortened.

In other words, when a depletion mode transistor is used for an analog switch included in the reverse bias applying circuit of the invention, the L/W of the transistor can be reduced, leading to the reduction in mounting area on a substrate.

In addition, the reverse bias applying circuit of the invention is characterized by utilizing potentials of an anode line and a cathode line. At this time, a range of a potential difference between the anode line and the cathode line is larger than a range of a power supply voltage. Therefore, even when using a depletion mode transistor, depending on a potential setting, the transistor can be assuredly turned off as needed due to the gate-source voltage. It is to be noted that a normally-on transistor may be used for both or either of an N-type transistor and a P-type transistor that constitute an analog switch. When using it for either of them, it is preferably used for a P-type transistor.

Embodiment

Embodiment 1

Figure 5:
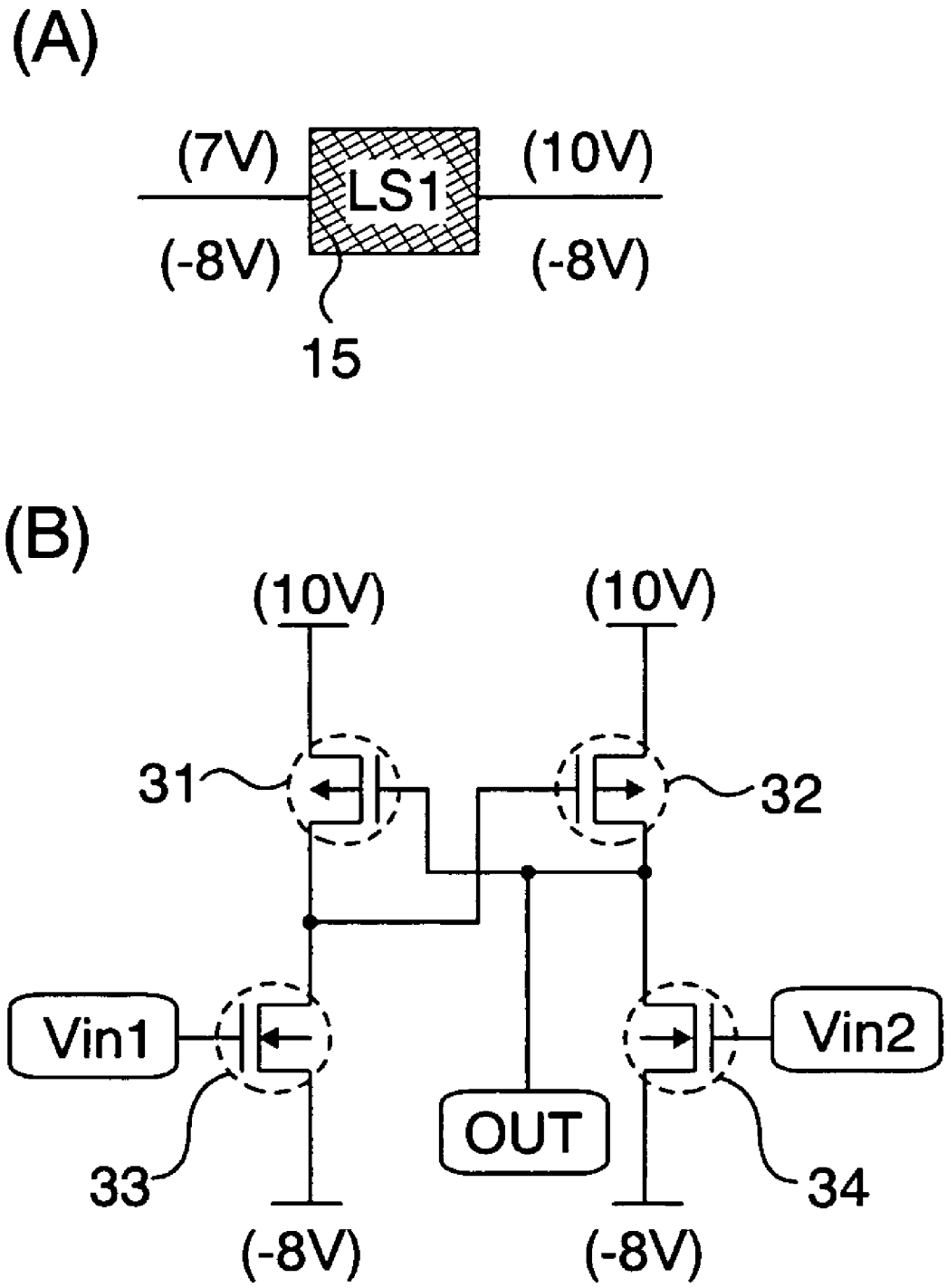
FIG. 5 shows diagrams of a level shifter (Embodiment 1).

In this embodiment, a level shifter of the reverse bias applying circuit 116 included in a scan line driver circuit is described with reference to FIG. 5.

In this embodiment, a configuration of a level shifter that changes 7 V to 10 V and −8 V to −8 V as shown in FIG. 5(A) is explained as an example. FIG. 5(B) is an equivalent circuit diagram of a level shifter that includes a P-channel transistor (hereinafter referred to as a transistor) 31 and an N-channel transistor (hereinafter referred to as a transistor) 33 that are connected in series, and a P-channel transistor (hereinafter referred to as a transistor) 32 and an N-channel transistor (hereinafter referred to as a transistor) 34 that are connected in series.

Operation thereof is described briefly. When a signal Vin1 of 7 V and a signal Vin2 of −8 V are inputted to the level shifter, the transistors 32 and 33 are turned on and a signal of 10 V is outputted to an OUT. On the other hand, when a signal Vin1 of −8 V and a signal Vin2 of 7 V are inputted to the level shifter, the transistor 34 is turned on and a signal of −8 V is outputted to the OUT. In this manner, the level shifter can set an inputted signal voltage to a desired value. When the level shifter is incorporated in the reverse bias applying circuit, source potentials of the transistors 31 and 32 and source potentials of the transistors 33 and 34 are set appropriately so as to output a desired signal voltage.

This embodiment can be implemented in combination with the aforementioned embodiment modes.

Embodiment 2

In the case of driving the display device of the invention in a digital drive, a time gray scale method is adopted in order to display a multi-level gray scale image. In this embodiment, timing of applying a reverse bias in a display device using the pixel shown in FIG. 9(A) is described with reference to FIGS. 6(A) and 6(B). FIG. 6(A) is a timing chart whose ordinate represents a scan line and abscissa represents time. FIG. 6(B) is a timing chart of a scan line in j-th row.

The display device has a frame frequency of approximately 60 Hz normally. That is, writing of image is performed 60 times per second, and a period of writing image once is referred to as a frame period. In the time gray scale method, one frame period is divided into a plurality of subframe periods. The number of divisions is equal to the number of bits in many cases, and the case where the number of divisions is equal to the number of bits is described herein for simplicity. That is, as 5-bit gray scale is shown as an example in this embodiment, an example that a frame period is divided into five subframe periods SF1 to SF5 is described. Each subframe period comprises an address period Ta for a video signal to be written to a pixel, and a sustain period Ts for the pixel to emit light or no light. The ratio of the sustain periods Ts1 to Ts5 is set as Ts1 : . . . . : Ts5=16:8:4:2:1. In other words, when displaying an image with n-bit gray scale, the ratio of n sustain periods is $2^{(n-1)}$: $2^{(n-2)}$: . . . . : $2^1$: $2^0$.

Figure 6:
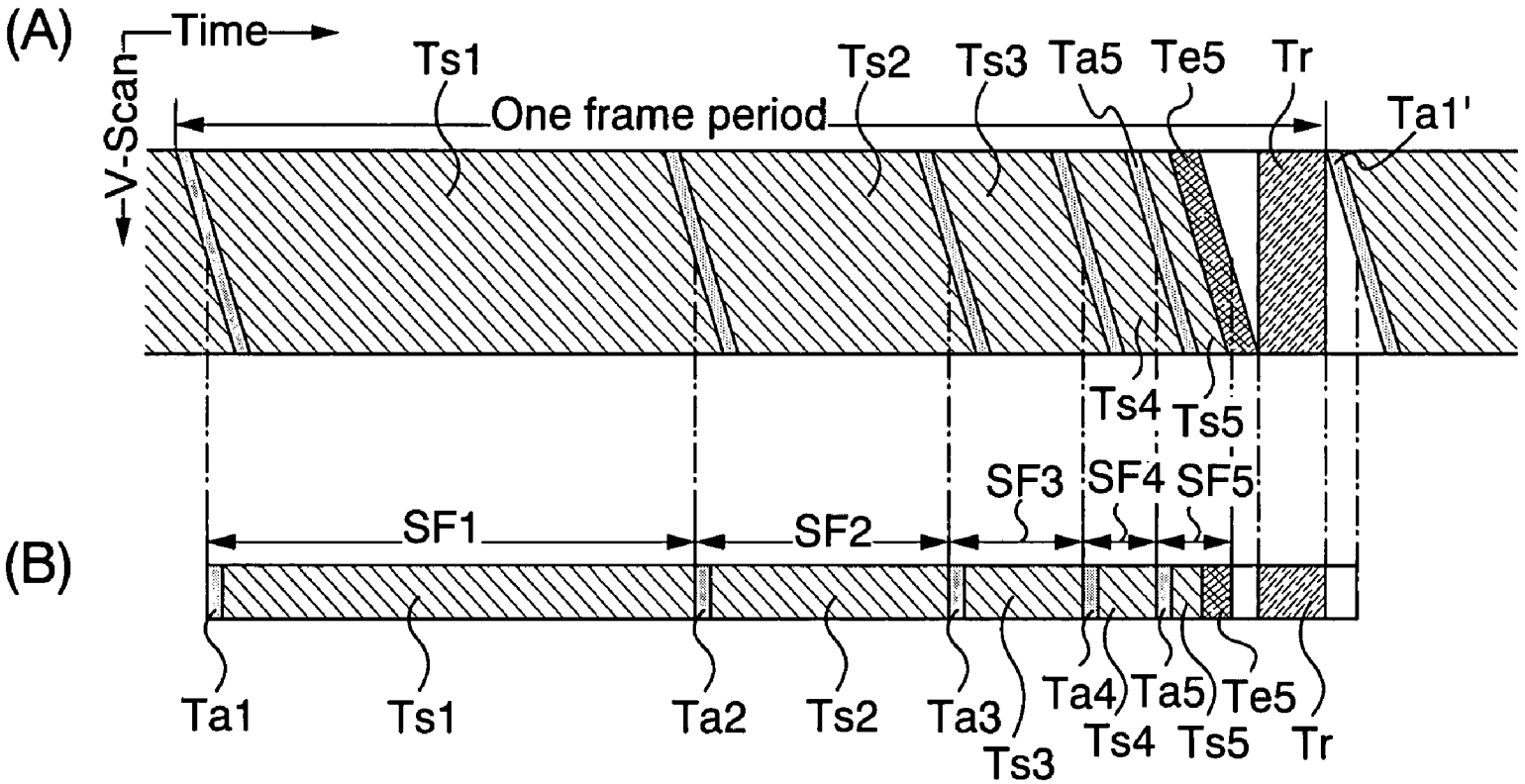
FIG. 6 shows a timing chart (Embodiment 2).

In FIG. 6, the subframe period SF5 has an erasing period Te5. During the erasing period Te5, a video signal which has been written to a pixel is reset. After the erasing period Te5, a reverse bias applying period Tr is provided. A reverse bias is applied to all the pixels during the reverse bias applying period Tr.

When the number of display gray scale levels has to be increased, the number of divisions of subframe periods may be increased. The order of subframe periods is not necessarily arranged from the most significant bit to the least significant bit, and it may be arranged at random in a frame period. Further, the order of subframe periods may be changed per frame period.

The reverse bias applying period Tr is not necessarily provided in all the frame periods, and it may be provided regularly or irregularly. In the case of the reverse bias applying period Tr being provided regularly, it may be provided, for instance, in every plurality of frame periods. Further, the subframe periods SF1 to SF5 and the reverse bias applying period Tr are not necessarily provided separately in one frame period. For example, the reverse bias applying period Tr may be provided in the light emitting periods Ts1 to Ts5 in a certain subframe period. That is, timing of applying a reverse bias to a light emitting element is not especially limited.

This embodiment can be implemented in combination with the aforementioned embodiment modes and embodiment.

Embodiment 3

Figure 7:
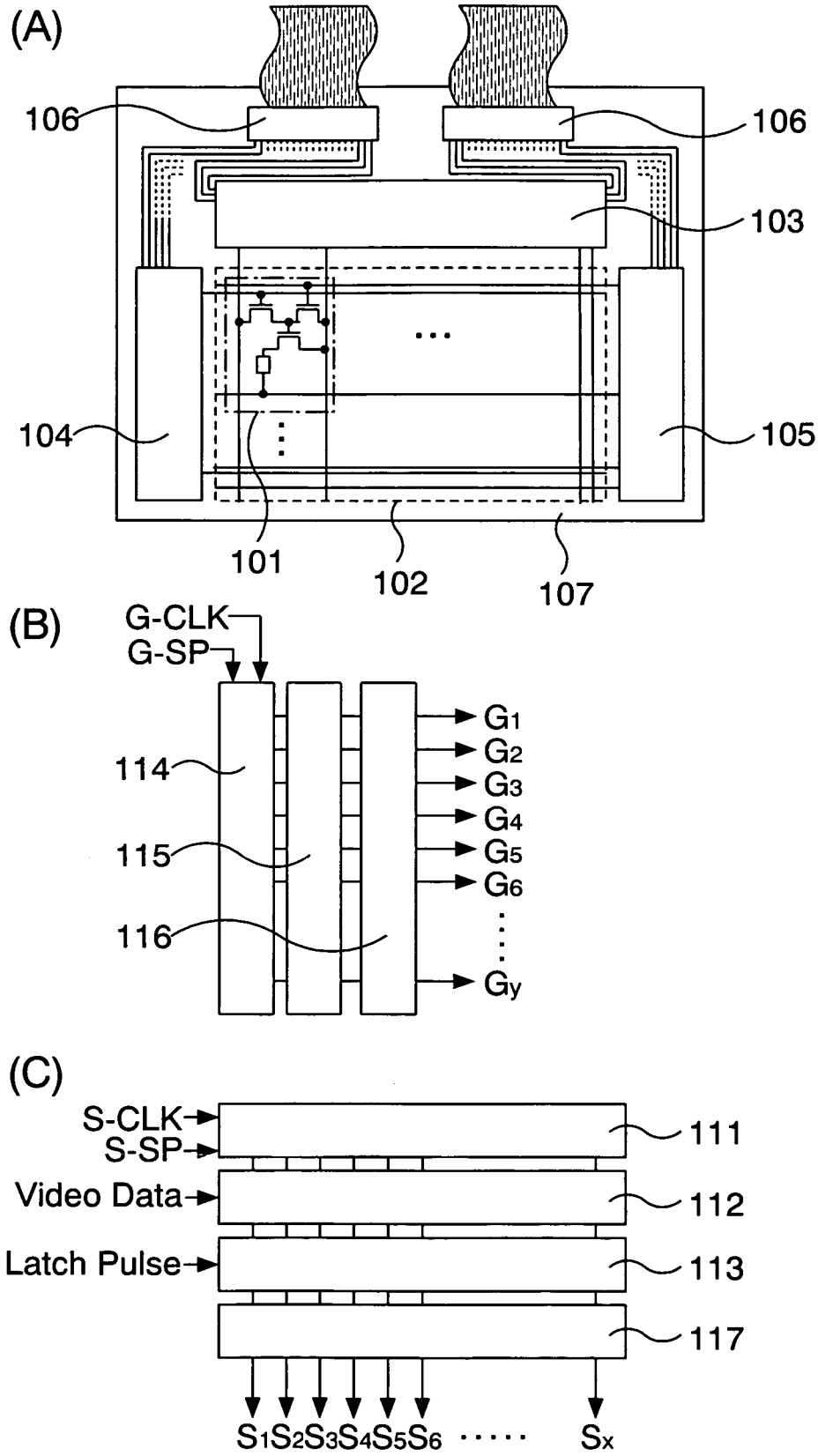
FIG. 7 shows diagrams of a panel, a scan line driver circuit and a signal line driver circuit (Embodiment 3).

In this embodiment, a configuration of a display device is described with reference to FIG. 7.

In FIG. 7(A), a pixel portion 102 in which a plurality of pixels 101 are arranged in matrix is formed on a substrate 107, and a signal line driver circuit 103, a first scan line driver circuit 104 and a second scan line driver circuit 105 are formed at the periphery of the pixel portion 102. Although the signal line driver circuit 103 and the two scan line driver circuits 104 and 105 are provided in FIG. 7(A), the invention is not limited to this, and the number of driver circuits may be arbitrarily set in accordance with a configuration of a pixel. These driver circuits are supplied with a signal externally through an FPC 106.

FIG. 7(B) shows a configuration of the first scan line driver circuit 104 and the second scan line driver circuit 105. The scan line driver circuits 104 and 105 each comprises a shift register 114, a buffer 115 and a reverse bias applying circuit 116. FIG. 7(C) shows a configuration of the signal line driver circuit 103. The signal line driver circuit 103 comprises a shift register 111, a first latch circuit 112, a second latch circuit 113, and a reverse bias applying circuit 117. As described here, the reverse bias applying circuits 116 and 117 of the invention are disposed at the periphery of the pixel portion 102.

The configurations of the scan line driver circuit and the signal line driver circuit are not limited to the foregoing, and they may comprise, for instance, a sampling circuit, a level shifter or the like. Further, circuits other than the driver circuits described above, such as a CPU and a controller may be integrally formed on the substrate 107. According to this, the number of external circuits (ICs) to be connected is reduced, and the reduction in weight and thickness can be accomplished, which is effective particularly for the portable terminal application.

The reverse bias applying circuit of the invention comprises an analog switch or a clocked inverter, and a biasing transistor. Thus, the number of elements that constitute the reverse bias applying circuit is small. Therefore, even in the case of the reverse bias applying circuit being incorporated in a driver circuit, it can be manufactured easily without occupying much area.

An anode line and a cathode line are connected through the FPC 106 to a power supply circuit (not shown) and a controller (not shown). The controller controls the power supply circuit that transfers a predetermined potential to a power supply line such as the anode line. When a potential of the power supply line such as the anode line is changed in order to apply a reverse bias to a light emitting element, a potential transferred to the power supply line by the power supply circuit is changed in accordance with a signal supplied from the controller.

This embodiment can be implemented in combination with the aforementioned embodiment modes and embodiments.

Embodiment 4

Figure 8:
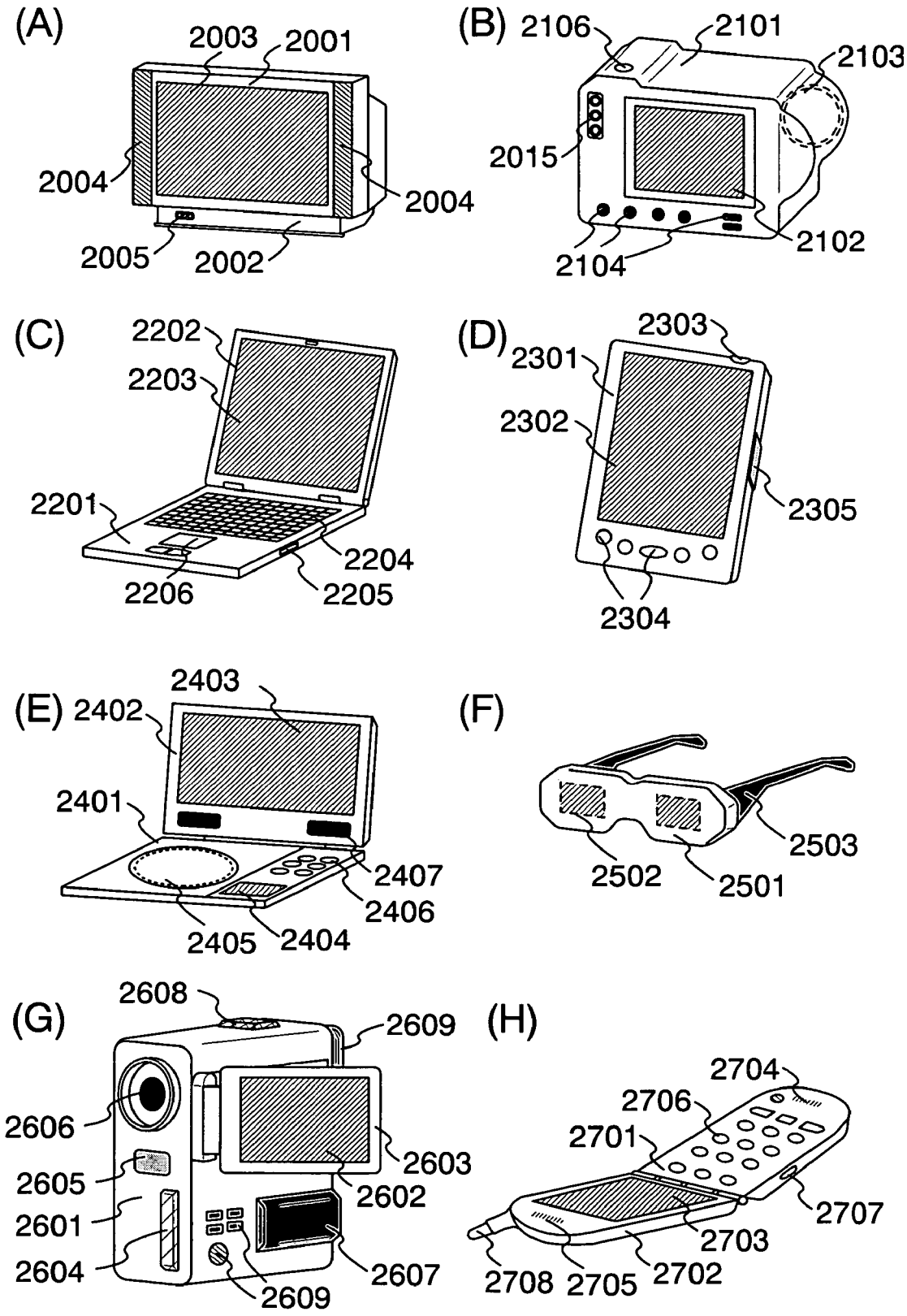
FIG. 8 shows diagrams of electronic apparatuses to which the invention is applied (Embodiment 4).

The invention can be applied to various electronic apparatuses such as a digital camera, an audio reproducing device such as a car audio system, a notebook personal computer, a game machine, a portable information terminal (portable phone, portable game machine, or the like), and an image reproducing device provided with a recording medium, such as a home game machine. Specific examples of these electronic apparatuses are shown in FIG. 8.

FIG. 8(A) illustrates a display device that includes a housing 2001, a supporting base 2002, a display portion 2003, speaker portions 2004, a video input terminal 2005 and the like. FIG. 8(B) illustrates a digital still camera that includes a main body 2101, a display portion 2102, an image receiving portion 2103, operating keys 2104, an external connecting port 2015, a shutter 2106 and the like. FIG. 8(C) illustrates a notebook personal computer that includes a main body 2201, a housing 2202, a display portion 2203, a keyboard 2204, an external connecting port 2205, a pointing mouse 2206 and the like.

FIG. 8(D) illustrates a mobile computer that includes a main body 2301, a display portion 2302, a switch 2303, operating keys 2304, an infrared port 2305 and the like. FIG. 8(E) illustrates a portable image reproducing device provided with a recording medium, that includes a main body 2401, a housing 2402, a display portion A2403, a display portion B2404, a recording medium reading portion 2405, an operating key 2406, a speaker portion 2407 and the like. The display portion A2403 displays mainly image data whereas the display portion B2404 displays mainly text data. FIG. 8(F) illustrates a goggle type display that includes a main body 2501, a display portion 2502 and an arm portion 2503.

FIG. 8(G) illustrates a video camera that includes a main body 2601, a display portion 2602, a housing 2603, an external connecting port 2604, a remote control receiving portion 2605, an image receiving portion 2606, a battery 2607, an audio input portion 2608, operating keys 2609 and the like. FIG. 8(H) illustrates a portable phone as a portable terminal, that includes a main body 2701, a housing 2702, a display portion 2703, an audio input portion 2704, an audio output portion 2705, an operating key 2706, an external connecting port 2707, an antenna 2708 and the like.

In the aforementioned electronic apparatuses, the invention is applied to a configuration of a display portion and a driving method of the display portion. According to the invention, even when including a panel using a light emitting element that may degrade with time, a reverse bias can be applied to the light emitting element without short-circuit, leading to the suppression of the degradation with time. Therefore, after being supplied to an end user, a reverse bias is applied to the light emitting element at the timing in which the end user does not use the apparatus, and thereby a longer life of the apparatus itself can be achieved.

This embodiment can be implemented in combination with the aforementioned embodiment modes and embodiments.

Embodiment 5

In the case of using a digital video signal, the video signal is either voltage or current. That is, in light emission of a light emitting element, a video signal inputted to a pixel is either constant voltage or constant current.

When a video signal is constant voltage, a voltage applied to a light emitting element may be constant or a current supplied to the light emitting element may be constant. When a video signal is constant current, a voltage applied to a light emitting element may be constant or a current supplied to the light emitting element may be constant.

A driving method in which a constant voltage is applied to a light emitting element is called a constant voltage drive, whereas a driving method in which a constant current is supplied to a light emitting element is called a constant current drive. In the constant current drive, a constant current flows independently of changes in resistance of a light emitting element.

For the display device of the invention and the driving method thereof, either a voltage video signal or a current video signal may be employed, and either the constant voltage drive or the constant current drive may be adopted.

In the case of a voltage video signal being used and a current supplied to a light emitting element being constant, it is preferable to set longer the channel length of a driving transistor for driving the light emitting element. This is because by setting the gate length longer than usual, a Vgs close to a threshold value is not used and thus variations in current values supplied to a light emitting element in each pixel can be suppressed.

In other words, when the gate length of a driving transistor is set longer than usual, a gate-source voltage Vgs of the driving transistor is not close to a threshold voltage. As a result, it is possible to suppress variations in current values supplied to a light emitting element connected in series with the driving transistor.

Embodiment 6

Figure 11:
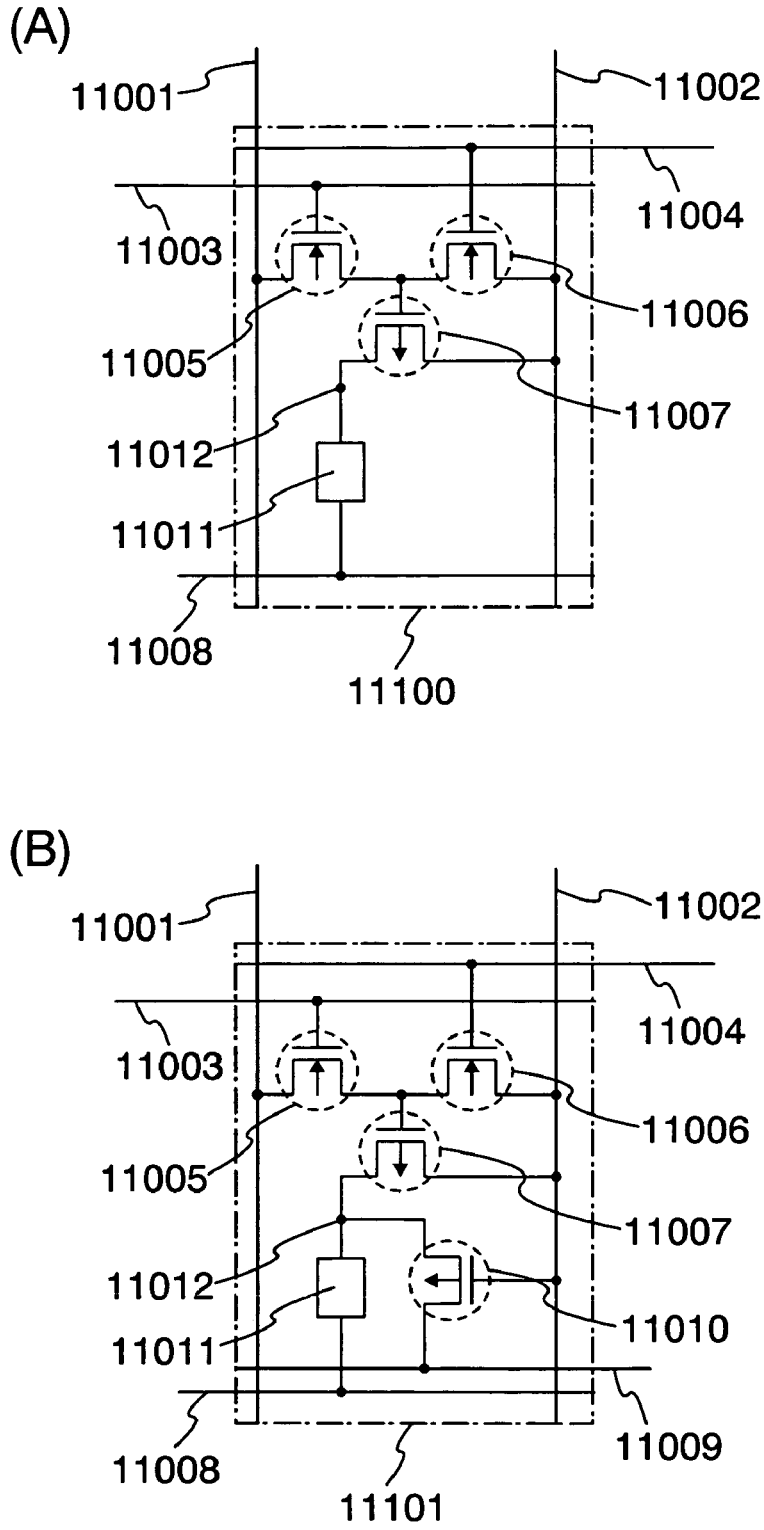
FIG. 11 shows diagrams of pixel configurations (Embodiment 6).

In this embodiment, a configuration and an operation of a pixel are described with reference to FIG. 11.

First, a configuration of a pixel 11100 is described with reference to FIG. 11(A). The pixel 11100 has a similar configuration as the pixel 101 shown in FIG. 1. The pixel 11100 comprises a signal line 11001, a first power supply line 11002 (also called an anode line), a scan line 11003, a reset line 11004, a writing transistor 11005, a reset transistor 11006, a driving transistor 11007, a second power supply line 11008 (also called a cathode line), and an EL element 11011 (also called a light emitting element).

Next, an operation of the pixel 11100 is described. A selective pulse is inputted to the scan line 11003, the writing transistor 11005 is turned on, and a video signal outputted to the signal line 11001 is inputted to a gate electrode of the driving transistor 11007. In the case of the video signal being H level, the driving transistor 11007 is turned off, while in the case of L level, the driving transistor 11007 is turned on. In accordance with on/off of the driving transistor 11007, a current supply to the EL element 11011 is controlled and light emission or non-light emission of the EL element 11011 is determined. The reset transistor 11006 is off at this time.

Subsequently, in the case of a current supply to the EL element 11011 being interrupted forcibly, a selective pulse is inputted to the reset line 11004, the reset transistor 11006 is turned on, and a potential of the first power supply line 11002 is inputted to the gate electrode of the driving transistor 11007. Then, a potential at the gate electrode of the driving transistor 11007 becomes equal to a potential at a source electrode thereof, and thereby the driving transistor 11007 is turned off.

In a reverse bias applying period, a potential of the first power supply line 11002 and a potential of the second power supply line 11008 are inverted. At this time, when a pixel electrode 11012 and the second power supply line 11008 are short-circuited due to defective deposition of the EL element and the like, the driving transistor 11007 is turned on and a current is supplied to the short-circuit point. Thus, the short-circuit point burns and is isolated. A pixel in which the pixel electrode 11012 and the second power supply line 11008 are short-circuited has such a defect that, for instance, it emits no light all the time or a desired luminance cannot be obtained. However, the defect is eliminated by supplying a current to the short-circuit point and insulating it as described above.

The case where the driving transistor 11007 is used as a current source is described with reference to FIG. 11(B).

A pixel 11101 comprises the signal line 11001, the first power supply line 11002, the scan line 11003, the reset line 11004, the writing transistor 11005, the reset transistor 11006, the driving transistor 11007, the second power supply line 11008, an AC power supply line 11009, an AC transistor 11010, the EL element 11011, and the pixel electrode 11012. The pixel 11101 is the same as the pixel 11100 except in that the AC power supply line 11009 and the AC transistor 11010 are added.

A gate electrode of the AC transistor 11010 is connected to the first power supply line 11002, either a source or a drain electrode thereof is connected to the pixel electrode 11012, and the other is connected to the AC power supply line 11009.

Although either the source or the drain electrode of the AC transistor 11010 is connected to the pixel electrode 11012 and the other electrode is connected to the AC power supply line 11009 in the aforementioned configuration, the other electrode may be connected to the signal line 11001. Further, a diode may be connected between the pixel electrode 11012 and the first power supply line 11002. In that case, the AC power supply line 11009 may be removed.

That is, the pixel 11100 comprises the EL element 11011, the writing transistor 11005 and the reset transistor 11006 that are connected in series, and the driving transistor 11007 and the AC transistor 11010 that are connected in series. The writing transistor 11005 and the reset transistor 11006 are connected in series between the first power supply line 11002 and the AC power supply line 11009 (also called a fourth power supply line). The driving transistor 11007 and the EL element 11011 (also called a light emitting element) are connected in series between the first power supply line 11002 and the second power supply line 11008. The driving transistor 11007 and the AC transistor 11010 are connected in series between the first power supply line 11002 and the AC power supply line 11009, or between the first power supply line 11002 and the signal line 11001.

Since the driving transistor 11007 is used as a constant current source here, a current value supplied to the EL element 11011 is determined by characteristics of the driving transistor 11007. Therefore, a transistor with a relatively high impedance is preferably used in accordance with the current value.

An operation of the pixel 11101 is described next. The operation in a forward bias applying period is the same as the foregoing.

In a reverse bias applying period, a potential of the first power supply line 11002 and a potential of the second power supply line 11008 are inverted. At this time, when the pixel electrode 11012 and the second power supply line 11008 are short-circuited due to defective deposition of the EL element 11011 and the like, the AC transistor 11010 is turned on and a current is supplied to the short-circuit point. Thus, the short-circuit point burns and is isolated. When the driving transistor 11007 has a high impedance, a current cannot be supplied sufficiently to isolate the short-circuit point. However, by adding the AC power supply line 11009 and the AC transistor 11010, a sufficient current can be supplied, leading to elimination of the defect.

In this embodiment, potentials of the first power supply line 11002 and the second power supply line 11008 are inverted in a reverse bias applying period, though the invention is not limited to this. The potential of the pixel electrode 11012 may be set lower than the potential of the second power supply line 11008. Further, although the writing transistor 11005 and the reset transistor 11006 are N-type transistors whereas the driving transistor 11007 and the AC transistor 11010 are P-type transistors in this embodiment, the polarity of the transistors is not limited to this and may be set arbitrarily.

The invention provides a display device in which a scan line driver circuit and a signal line driver circuit that control the pixels 11100 and 11101 having the aforementioned configuration are provided with the reverse bias applying circuit described in the embodiment modes. The reverse bias applying circuit comprises an analog switch whose first control node is connected to the first power supply line 11002 and second control node is connected to the second power supply line 11008. The reverse bias applying circuit further comprises a biasing transistor whose gate electrode is connected to a power supply line, either a source electrode or a drain electrode is connected to the first power supply line 11002, and the other electrode is connected to an output node of the analog switch and the signal line 11001. In the case of such a configuration, an input node of the analog switch is connected to a circuit adjacent to the reverse bias applying circuit (for instance, a buffer). Alternatively, as another configuration, the reverse bias applying circuit comprises a clocked inverter in which a transistor whose source electrode has the same potential as a low level potential and gate electrode is connected to the first power supply line is disposed at one end while a transistor whose source electrode has the same potential as a high level potential and gate electrode is connected to the second power supply line is disposed at the other end. The reverse bias applying circuit further comprises a biasing transistor whose gate electrode is connected to the power supply line, either a source electrode or a drain electrode is connected to the first power supply line, and the other electrode is connected to an output node of the clocked inverter and the scan line. In the case of such a configuration, an input node of the clocked inverter is connected to a circuit adjacent to the reverse bias applying circuit. According to the invention including the reverse bias applying circuit, the first power supply line and a power supply line included in the signal line driver circuit can be prevented from being short-circuited. In addition, by applying a reverse bias, it is possible to provide a display device in which degradation of a light emitting element with time is suppressed.

Embodiment 7

In this embodiment, an example of a top view of the pixel shown in FIG. 11(A) is described with reference to FIG. 10.

Figure 10:
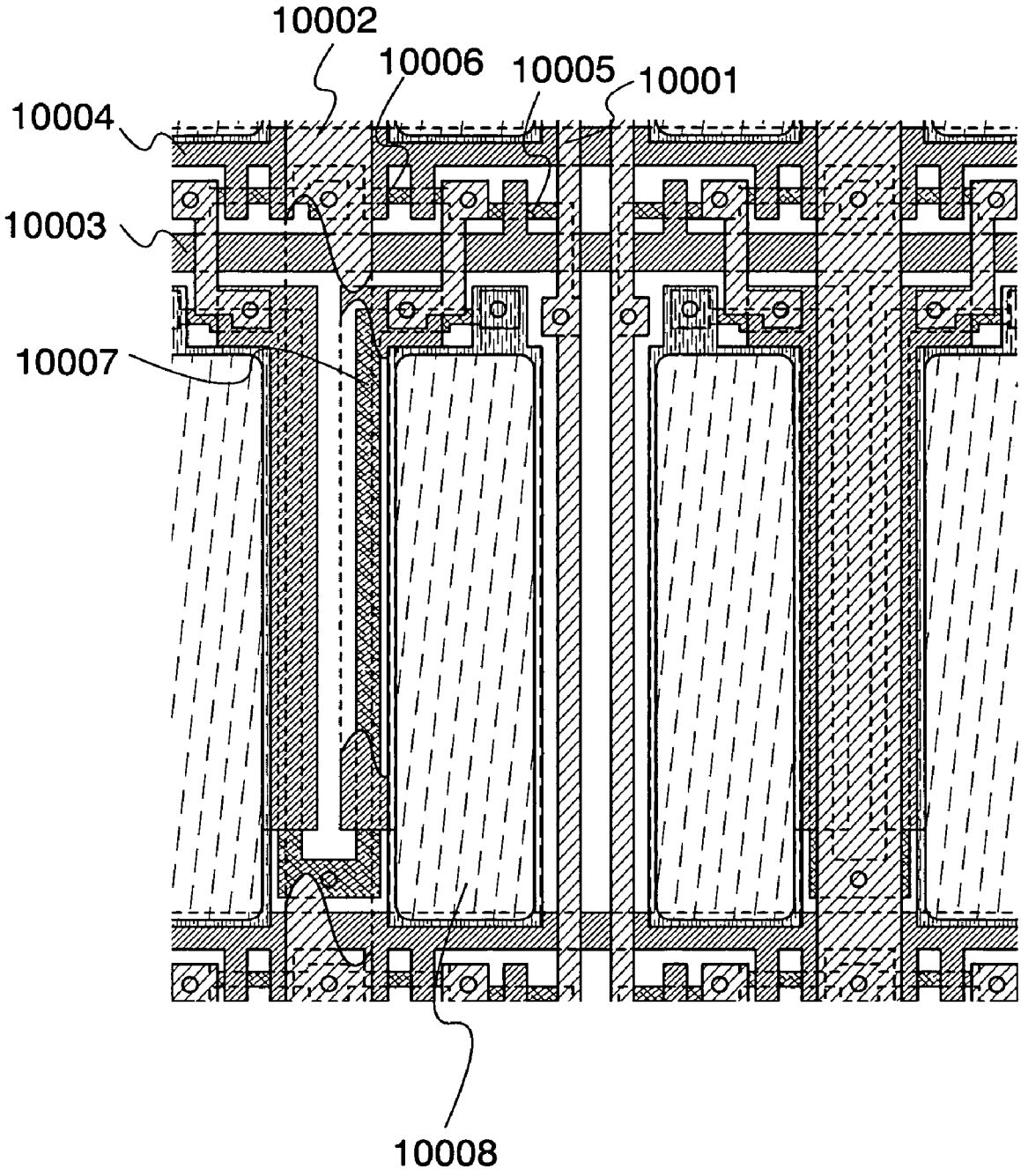
FIG. 10 shows an example of a top plan view of a pixel (Embodiment 7).

The signal line 11001 of the pixel 11100 in FIG. 11(A) corresponds to a signal line 10001 in FIG. 10, the first power supply line 11002 corresponds to a power supply line 10002 in FIG. 10, the scan line 11003 corresponds to a scan line 10003 in FIG. 10, the reset line 11004 corresponds to a reset line 10004 in FIG. 10, the writing transistor 11005 corresponds to a writing transistor 10005 in FIG. 10, the reset transistor 11006 corresponds to a reset transistor 10006 in FIG. 10, the driving transistor 11007 corresponds to a driving transistor 10007 in FIG. 10, and the pixel electrode 11012 corresponds to a pixel electrode 10008 in FIG. 10.

As shown in this embodiment, the power supply line 10002 is shared between pixels adjacent to each other, and the driving transistor 10007 is disposed under the power supply line 10002, and thereby a sufficient storage capacitance can be obtained between a gate electrode of the driving transistor 10007 and the power supply line 10002. Further, since the storage capacitance is away from the signal line 10001, the influence of noise on the signal line can be suppressed.

In the case of characteristics of EL elements being different according to RGB, when white balance is adjusted by varying a potential of each power supply line according to RGB, the power supply line is not required to be shared as described above.

Embodiment 8

In this embodiment, an example of a top plan view of the pixel 11101 shown in FIG. 11(B) is described with reference to FIG. 12.

Figure 12:
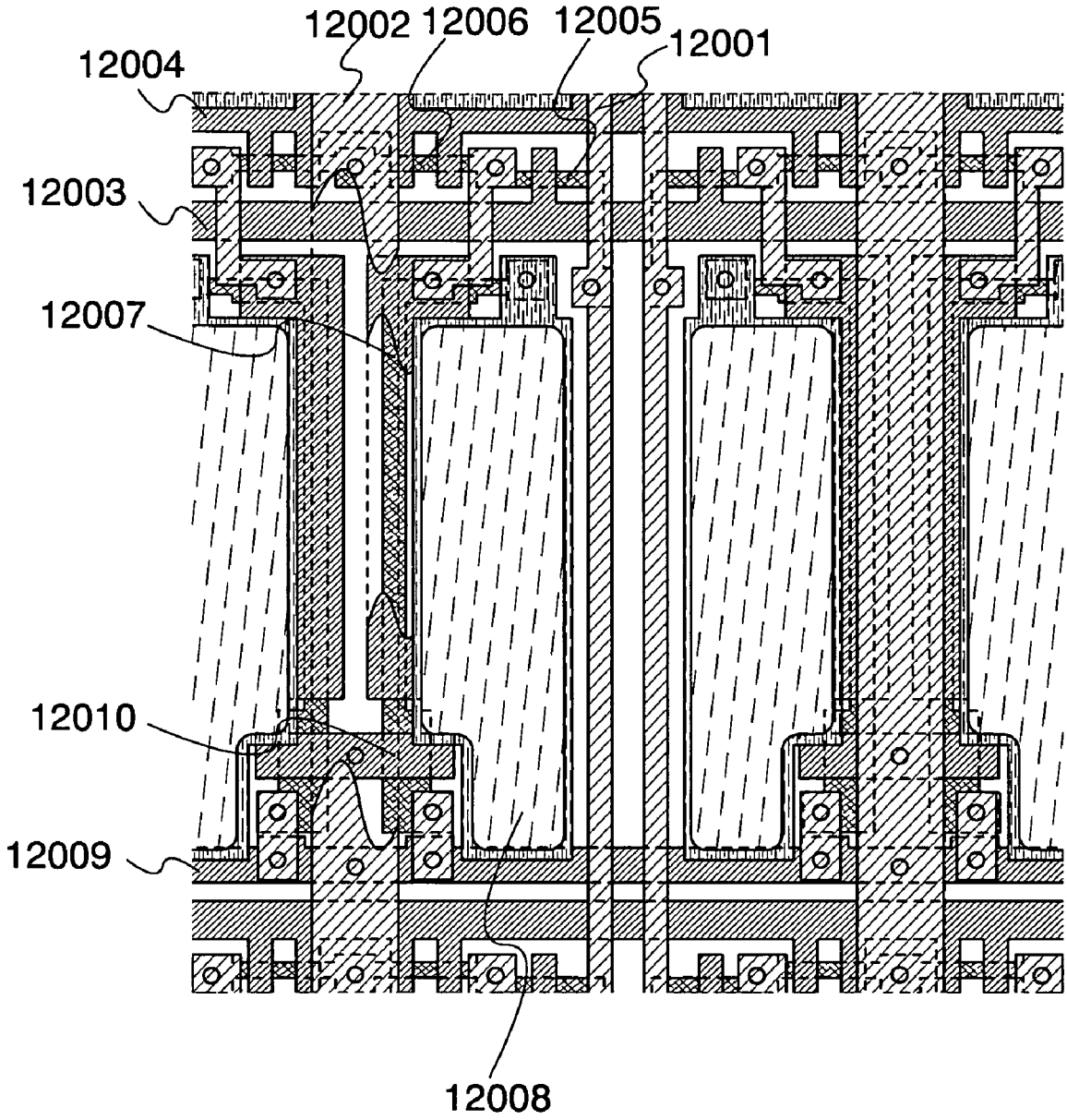
FIG. 12 shows an example of a top view of a pixel (Embodiment 8).

The signal line 11001 of the pixel 11101 in FIG. 11(B) corresponds to a signal line 12001 in FIG. 12, the first power supply line 11002 corresponds to a power supply line 12002 in FIG. 12, the scan line 11003 corresponds to a scan line 12003 in FIG. 12, the reset line 11004 corresponds to a reset line 12004 in FIG. 12, the writing transistor 11005 corresponds to a writing transistor 12005 in FIG. 12, the reset transistor 11006 corresponds to a reset transistor 12006 in FIG. 12, the driving transistor 11007 corresponds to a driving transistor 12007 in FIG. 12, the AC power supply line 11009 corresponds to an AC power supply line 12009 in FIG. 12, the AC transistor 11010 corresponds to an AC transistor 12010 in FIG. 12, and the pixel electrode 11012 corresponds to a pixel electrode 12008 in FIG. 12.

As shown in this embodiment, the power supply line 12002 is shared between pixels adjacent to each other, and the driving transistor 12007 is disposed under the power supply line 12002, and thereby a sufficient storage capacitance can be obtained between a gate electrode of the driving transistor 12007 and the power supply line 12002. Further, since the storage capacitance is away from the signal line 12001, the influence of noise on the signal line can be suppressed.

In the case of characteristics of EL elements being different according to RGB, when white balance is adjusted by varying a potential of each power supply line according to RGB, the power supply line is not required to be shared as described above.

Embodiment 9

With reference to the drawings, explanation is made on a panel mounting a display area and a driver as one mode of the display device of the invention. On a substrate 1405, provided are a display area 1404 having a plurality of pixels each including a light emitting element, a source driver 1403 (also called a signal line driver circuit), a first gate driver 1401 (also called a scan line driver circuit), a second gate driver 1402, a connecting terminal 1415, and a connecting film 1407 (See FIGS. 13(A) and 13(B)). The connecting terminal 1415 is connected through anisotropic conductive particles and the like to the connecting film 1407. The connecting film 1407 is connected to an IC chip.

Figure 13:
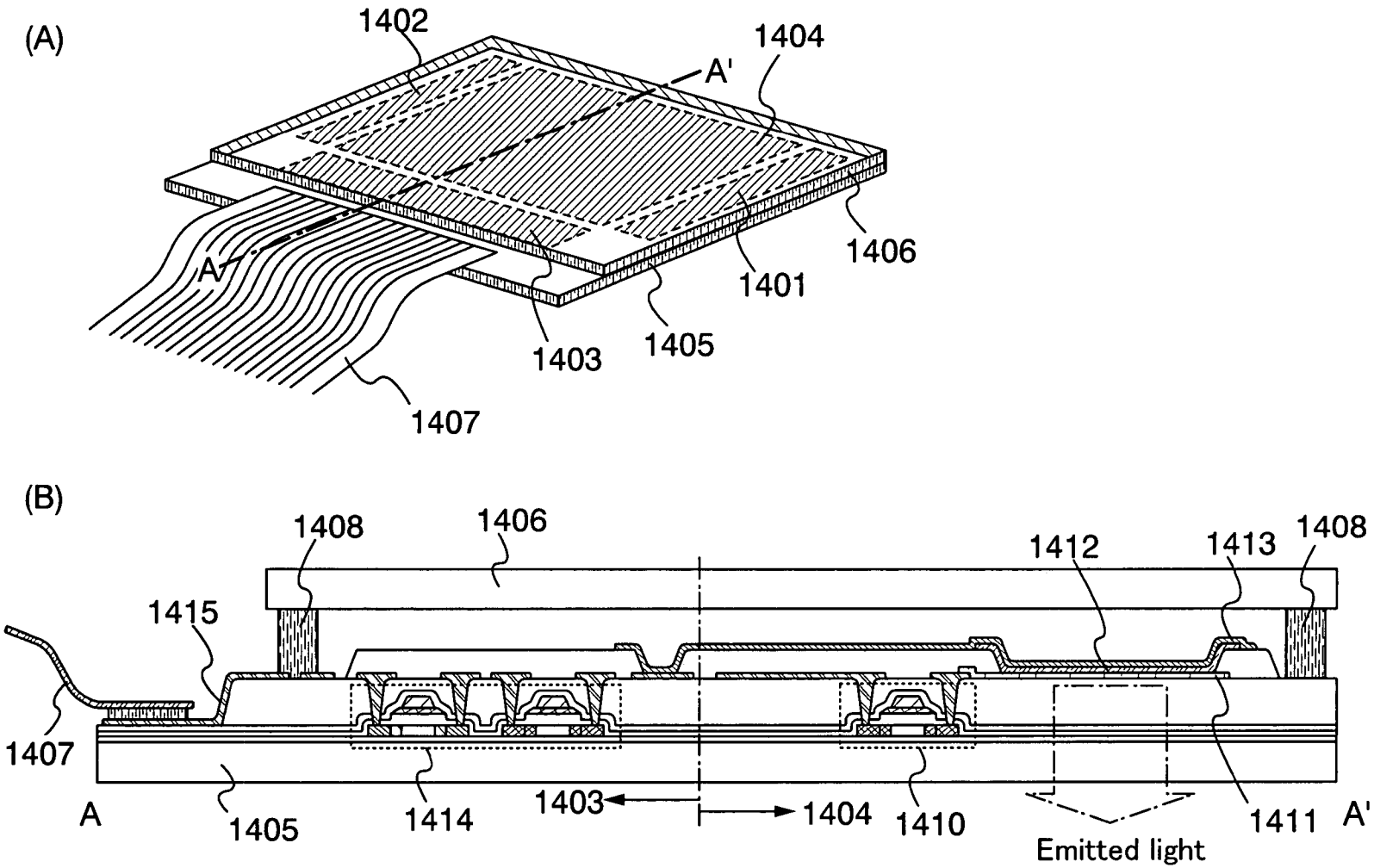
FIG. 13 shows a cross sectional view of a bottom emission panel (Embodiment 9).

FIG. 13(B) is a cross sectional view taken by cutting along a line A-A' of the panel, and shows a driving TFT 1410 provided in the display area (also called a pixel portion) 1404 and a CMOS circuit 1414 provided in the source driver 1403. FIG. 13(B) further shows a conductive layer 1411, an electroluminescent layer 1412 and a conductive layer 1413 that are provided in the display area 1404. The conductive layer 1411 is connected to a source electrode or a drain electrode of the driving TFT 1410. The conductive layer 1411 functions as a pixel electrode whereas the conductive layer 1413 functions as a opposite electrode. The stack of the conductive layer 1411, the electroluminescent layer 1412 and the conductive layer 1413 corresponds to a light emitting element.

A sealing member 1408 is provided so as to surround the display area 1404, the gate drivers 1401 and 1402, and the source driver 1403. The light emitting element is sealed by the sealing member 1408 and a opposite substrate 1406. This sealing treatment is carried out in order to protect the light emitting element from moisture. Although the method of sealing by a cover material (glass, ceramics, plastic, metal and the like) carries out here, it may be used the method using a heat curing resin or a UV curing resin, or using a thin film having high barrier properties such as metal oxide and nitride.

The elements formed over the substrate 1405 are preferably formed by a crystalline semiconductor (polysilicon) that has better characteristics of mobility and the like than an amorphous semiconductor According to this, the elements can be monolithically formed over the same surface. A panel with such a configuration has less external ICs to be connected, leading to reduction in size, weight and thickness.

In FIG. 13(B), the conductive layer 1411 is formed of a transparent conductive film whereas the conductive layer 1413 is formed of a reflective film. Therefore, light from the electroluminescent layer 1412, as shown by an arrow, transmits the conductive layer 1411 to be emitted in the direction of the substrate 1405. Such a configuration is called a bottom emission method in general, and a panel that adopts the bottom emission method is called a bottom emission panel.

Meanwhile, when the conductive layer 1411 is formed of a reflective film and the conductive layer 1413 is formed of a transparent film, as shown in FIG. 14(A), light from the electroluminescent layer 1412 can be emitted in the direction of the opposite substrate 1406. Such a configuration is called a top emission method in general. A panel that adopts the top emission method is called a top emission panel.

Either the source electrode or the drain electrode of the driving TFT 1410 and the conductive layer 1411 are stacked on the same layer without an insulating layer interposed therebetween, and connected directly by stacking films. Accordingly, the conductive layer 1411 is formed in areas other than areas in which the TFT and the like are formed, therefore, an opening ratio cannot be prevented from being lowered in accordance with high definition and the like of a pixel. Thus, as shown in FIG. 14(B), a pixel electrode is formed on an interlayer film 1416 additionally provided, and the top emission method is adopted in order to effectively utilize the areas in which the TFT and the like are formed as light emitting areas. At this time, depending on the film thickness of the electroluminescent layer 1412, the conductive layer 1411 and the conductive layer 1413 may be short-circuited in a contact area between the conductive layer 1411 corresponding to the pixel electrode and the source electrode or the drain electrode of the driving TFT 1410. Therefore, a configuration for preventing the short-circuit is desirably adopted by providing a bank 1417 and the like.

That is, the configuration shown in FIG. 14(B) allows the opening ratio to be improved.

Figure 15:
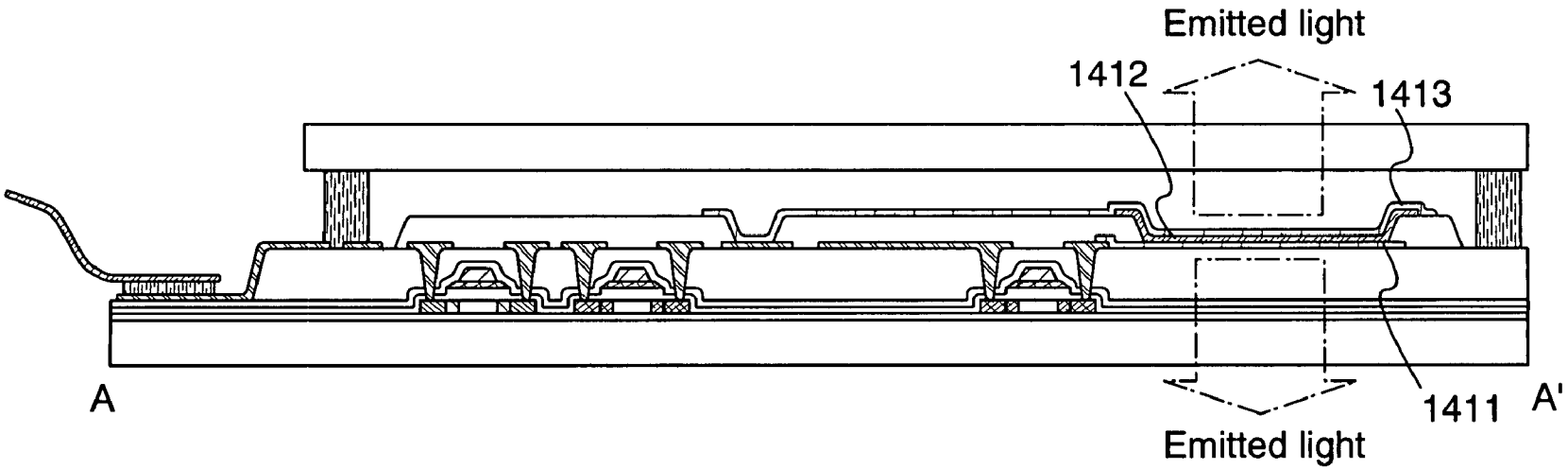
FIG. 15 shows a cross sectional view of a dual emission panel (Embodiment Mode 9).

Furthermore, as shown in FIG. 15, when the conductive layer 1411 and the conductive layer 1413 are both formed of a transparent conductive film, light from the electroluminescent layer 1412 can be emitted in both directions of the substrate 1405 and the opposite substrate 1406. Such a configuration is called a dual emission method. A panel that adopts the dual emission method is called a dual emission panel.

In the case of the configuration shown in FIG. 15, a light emitting area of the top emission side is substantially equal to a light emitting area of the bottom emission side. However, it is needless to say that when an area of the pixel electrode is increased by adding an interlayer film as described above, the opening ratio in the top emission side can be increased.

Note that the configuration of the display device of the invention is not limited to the aforementioned embodiment. For example, the display area 1404 may be formed of a TFT in which an amorphous semiconductor (amorphous silicon) formed on an insulating surface is used for a channel portion, and the drivers 1401 to 1403 may be formed by an IC chip. The IC chip may be attached on the substrate by COG or attached to a connecting film to be attached to the substrate 1405. The amorphous semiconductor can be formed on a large substrate by CVD without requiring crystallization steps, and thereby it allows to provide an inexpensive panel. Further, when a conductive layer is formed by a droplet ejection method typified by ink-jet printing at this time, a less expensive panel can be achieved. This embodiment can be implemented in combination with the aforementioned embodiment modes and embodiments.

Embodiment 10

Described is a configuration of a light emitting element that is a component of the display device of the invention. The light emitting element corresponds to the stack of a conductive layer, an electroluminescent layer and a conductive layer, that is formed over a surface of a substrate having an insulating surface such as glass, quartz, metal, and an organic material. The light emitting element may be a laminated layers type that is formed of a plurality of electroluminescent layers, a single layer type that is formed of a single electroluminescent layer, or a mixed type that is formed of a plurality of electroluminescent layers having indefinable boundaries. As a laminated structure of the light emitting element, there are a forward lamination in which a conductive layer corresponding to an anode, an electroluminescent layer, a conductive layer corresponding to a cathode are stacked in this order from bottom, and a reverse lamination in which a conductive layer corresponding to a cathode, an electroluminescent layer, a conductive layer corresponding to an anode are stacked in this order from bottom. Either of the forward lamination or the reverse lamination may be selected appropriately depending on a light emitting direction. For the electroluminescent layer, an organic material (low molecular weight, high molecular weight, or medium molecular weight), a material combining an organic material and an inorganic material, a singlet material, a triplet material, or a combination thereof may be employed.

It is to be noted that an anode of a light emitting element is one of a pixel electrode and a opposite electrode thereof, and a cathode of the light emitting element is the other of the pixel electrode and the opposite electrode thereof.

Figure 14:
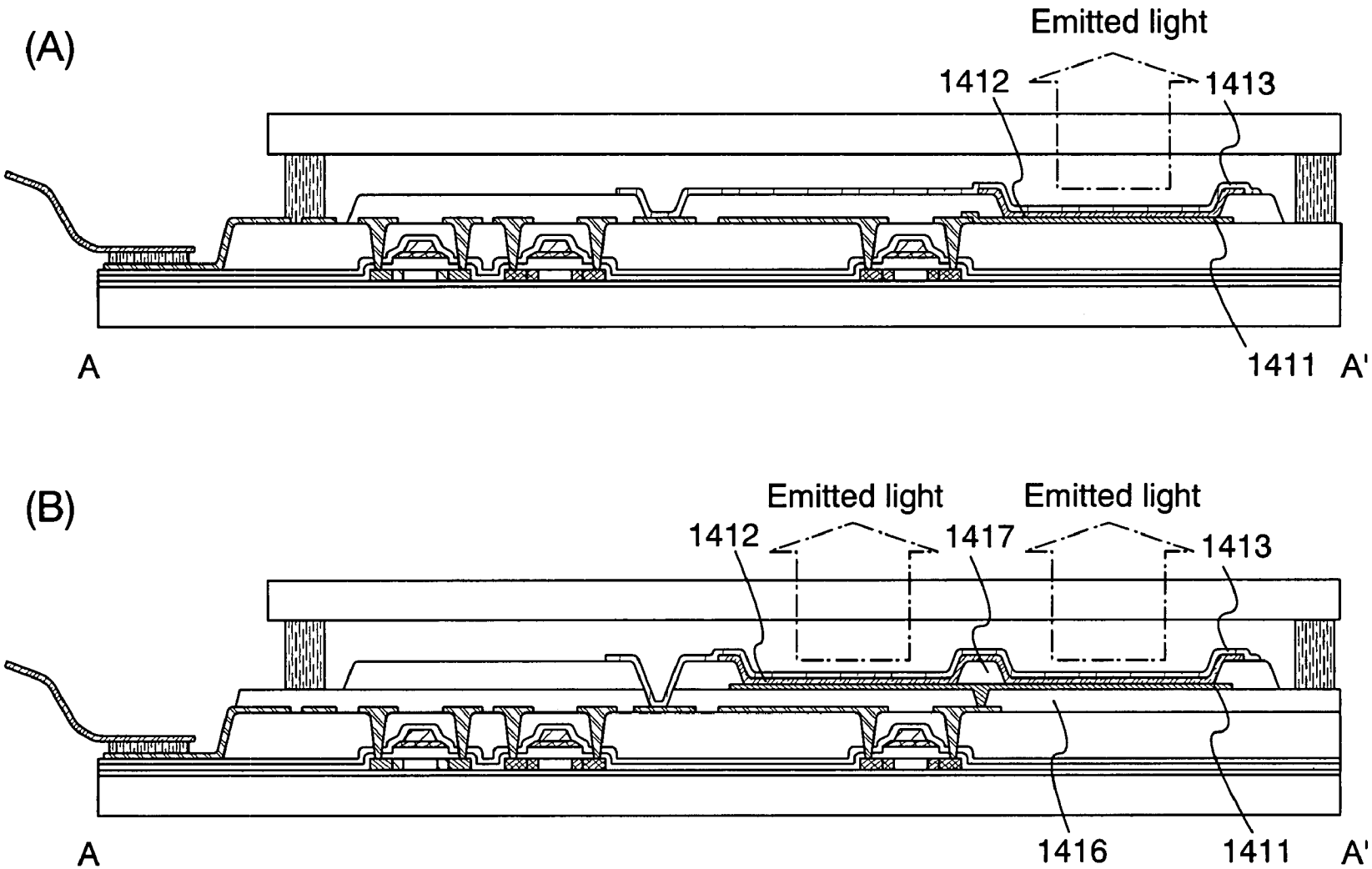
FIG. 14 shows cross sectional views of a top emission panel (Embodiment 9).

As shown in FIGS. 13(B), 14 and 15, light emitting directions of a light emitting element can be classified as follows: light emission to a substrate side (bottom emission method); light emission to a opposite substrate side that is opposed to the substrate (top emission method); and light emission to the substrate side and the opposite substrate side, namely in the directions of a surface and the opposite surface of the substrate (dual emission method). In the case of dual emission, both the substrate and the opposite substrate necessarily have a light transmissivity. The luminescence from the light emitting element includes luminescence that is generated when an excited singlet state returns to a ground state (fluorescence) and luminescence that is generated when an excited triplet state returns to a ground state (phosphorescence). The invention can use either or both of these two types of luminescence.

Note that the state in which the light emitting element is supplied with a current and emits light corresponds to a state in which a forward bias voltage is applied between two electrodes of the light emitting element.

According to the light emitting element, wide viewing angle and reduction in thickness and weight without a need of backlight are achieved. In addition, since the light emitting element exhibits fast response, it is suitable for dynamic display. The display device using such a light emitting element allows to realize both high function and high added value. This embodiment can be implemented in combination with the aforementioned embodiment modes and embodiments.

Embodiment 11

A light emitting element has a configuration that a single or a plurality of layers formed of various materials (hereinafter referred to as electro luminescent layers) are disposed between a pair of electrodes. In the light emitting element, an initial failure in which an anode and a cathode are short-circuited may occur due to the following factors. As a first factor, a short-circuit between the anode and the cathode caused by the deposition of foreign material (dust), as a second factor, short-circuit between the anode and the cathode caused by pinholes due to a minute projection of anode (unevenness), or as a third factor, short-circuit between the anode and the cathode caused by pinholes in a electroluminescent layer due to uneven deposition of the electroluminescent layer. The third factor is also concerned with a thinness of the electroluminescent layer. In a pixel having such an initial failure, problems occur such that light emission and non-light emission are not carried out in accordance with signals, and thus almost all currents flow in the short-circuit point and a phenomenon that the whole element emits no light or certain pixels emits light or no light, leading the problem that display of images does not operates favorably. In view of the foregoing problems, as set forth above, the invention provides a display device in which a reverse bias is applied to a light emitting element and a driving method thereof. By applying a reverse bias, a current is locally supplied only to a short-circuit point between an anode and a cathode, and the short-circuit point generates heat. Thus, the short-circuit point is oxidized or carbonized to be isolated. As a result, it is possible to provide a display device in which even when an initial failure occurs, the initial failure can be eliminated and the image can be displayed favorably. It is to be noted that such isolation of the initial failure is preferably carried out before shipment.

In addition to the aforementioned initial failure, a progressive failure may occur in a light emitting element. The progressive failure means that an anode and a cathode are newly short-circuited as time passes. Such a short-circuit between an anode and a cathode that newly occurs as time passes is caused by a minute projection of the anode. That is, in the stack of a pair of electrodes with an electroluminescent layer interposed therebetween, the anode and the cathode are short-circuited as time passes. In view of the foregoing problem, the invention provides, as set forth above, a display device that applies a reverse bias regularly as well as before shipment, and a driving method thereof. When applying a reverse bias, a current flows locally in a short-circuit point only, leading to isolation of the short-circuit point. As a result, it is possible to provide a display device that, even when a progressive failure occurs, can solve the failure and display an image favorably, and a driving method thereof.

The stack of a pair of electrodes with an electroluminescent layer interposed therebetween has a point that does not emit light even when a forward bias voltage is applied. Such a non-light emitting failure is called a dark spot, and since progressing with time, it is also called a progressive failure. The dark spot is caused by a contact failure of an electroluminescent layer and a cathode, and considered to progress when a minute void between the electroluminescent layer and the cathode spreads. However, such a void can be prevented from spreading when a reverse bias being applied, namely, the progression of a dark spot can be suppressed. Therefore, according to the invention that applies a reverse bias as described above, a display device that suppresses the progression of a dark spot can be achieved as well as a driving method thereof.

The invention claimed is:

1. A display device comprising:

a light emitting element;

a clocked inverter including a first transistor and a second transistor; and a biasing transistor, wherein one of a first electrode and a second electrode of the light emitting element is electrically connected to a first power supply line, and the other is electrically connected to a second power supply line;

wherein a gate electrode of the first transistor is electrically connected to the first power supply line, and a gate electrode of the second transistor is electrically connected to the second power supply line; and wherein a gate electrode of the biasing transistor is electrically connected to a third power supply line, one of a source electrode and a drain electrode of the biasing transistor is electrically connected to the first power supply line, and the other is electrically connected to an output terminal of the clocked inverter and a scan line.

2. The display device according to claim 1, further comprising a plurality of transistors disposed between the first power supply line and the signal line, wherein a gate electrode of a transistor selected from the plurality of transistors is electrically connected to the scan line.

3. A display device according to claim 1, wherein the display device is incorporated into at least one selected from the group consisting of digital camera, an audio reproducing device such as a car audio system, a notebook personal computer, a game machine, a portable information terminal such as portable phone, portable game machine, and an image reproducing device provided with a recording medium, such as a home game machine.

4. A display device comprising:

a light emitting element;

a clocked inverter including a first transistor and a second transistor;

a biasing transistor; and a level shifter, wherein one of a first electrode and a second electrode of the light emitting element is electrically connected to a first power supply line, and the other is electrically connected to a second power supply line;

wherein a gate electrode of the first transistor is electrically connected to the first power supply line, and a gate electrode of the second transistor is electrically connected through the level shifter to the second power supply line; and wherein a gate electrode of the biasing transistor is electrically connected to a third power supply line, one of a source electrode and a drain electrode of the biasing transistor is electrically connected to the first power supply line, and the other is electrically connected to an output terminal of the clocked inverter and a scan line.

5. The display device according to claim 4, further comprising a plurality of transistors disposed between the first power supply line and the signal line, wherein a gate electrode of a transistor selected from the plurality of transistors is electrically connected to the scan line.

6. A display device according to claim 4, wherein the display device is incorporated into at least one selected from the group consisting of digital camera, an audio reproducing device such as a car audio system, a notebook personal computer, a game machine, a portable information terminal such as portable phone, portable game machine, and an image reproducing device provided with a recording medium, such as a home game machine.

7. A display device comprising:

a light emitting element;

a clocked inverter including a first transistor and a second transistor;

a biasing transistor; and a first level shifter and a second level shifter, wherein one of a first electrode and a second electrode of the light emitting element is electrically connected to a first power supply line, and the other is electrically connected to a second power supply line;

wherein a gate electrode of the first transistor is electrically connected through the first level shifter to the first power supply line, and a gate electrode of the second transistor is electrically connected through the second level shifter to the second power supply line; and wherein a gate electrode of the biasing transistor is electrically connected to a third power supply line, one of a source electrode and a drain electrode of the biasing transistor is electrically connected to the first power supply line, and the other is electrically connected to an output terminal of the clocked inverter and a scan line.

8. The display device according to claim 7, further comprising a plurality of transistors disposed between the first power supply line and the signal line, wherein a gate electrode of a transistor selected from the plurality of transistors is electrically connected to the scan line.

9. A display device according to claim 7, wherein the display device is incorporated into at least one selected from the group consisting of digital camera, an audio reproducing device such as a car audio system, a notebook personal computer, a game machine, a portable information terminal such as portable phone, portable game machine, and an image reproducing device provided with a recording medium, such as a home game machine.

10. A driving method of a display device comprising a light emitting element, a clocked inverter including a first transistor and a second transistor, and a biasing transistor, wherein one of a first electrode and a second electrode of the light emitting element is electrically connected to a first power supply line, and the other is electrically connected to a second power supply line;

wherein a gate electrode of the first transistor is electrically connected to the first power supply line, and a gate electrode of the second transistor is electrically connected to the second power supply line; and wherein a gate electrode of the biasing transistor is electrically connected to a third power supply line, one of a source electrode and a drain electrode of the biasing transistor is electrically connected to the first power supply line, and the other is electrically connected to an output terminal of the clocked inverter and a scan line, the method comprising the steps of:

inverting a potential of the first power supply line and a potential of the second power supply line;

applying a reverse bias to the light emitting element;

making the clocked inverter enter a high impedance state and turning on the biasing transistor; and making the potential of the first power supply line equal to a potential of the scan line.

11. A display device according to claim 10, wherein the display device is incorporated into at least one selected from the group consisting of digital camera, an audio reproducing device such as a car audio system, a notebook personal computer, a game machine, a portable information terminal such as portable phone, portable game machine, and an image reproducing device provided with a recording medium, such as a home game machine.

* * * * *